US008150298B2

(12) United States Patent
Kobayashi

(10) Patent No.: US 8,150,298 B2
(45) Date of Patent: Apr. 3, 2012

(54) TONER CARTRIDGE WITH PROTRUSION PORTION AND IMAGE FORMING APPARATUS

(75) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 520 days.

(21) Appl. No.: 12/071,449

(22) Filed: Feb. 21, 2008

(65) Prior Publication Data

US 2008/0213005 A1 Sep. 4, 2008

(30) Foreign Application Priority Data

Mar. 2, 2007 (JP) ..... 2007-053125

(51) Int. Cl.
*G03G 15/08* (2006.01)

(52) U.S. Cl. ..... 399/262

(58) Field of Classification Search ..... 399/262, 399/258, 260
See application file for complete search history.

(56) References Cited

U.S. PATENT DOCUMENTS

| | | | | |
|---|---|---|---|---|
| 7,010,252 | B2 * | 3/2006 | Nozawa | 399/262 |
| 7,302,213 | B2 * | 11/2007 | Kimura et al. | 399/262 |
| 7,327,975 | B2 * | 2/2008 | Tanaka | 399/262 |
| 7,379,692 | B2 * | 5/2008 | Yamane | 399/258 |
| 7,574,160 | B2 * | 8/2009 | Jung et al. | 399/258 |
| 7,848,684 | B2 * | 12/2010 | Kawai | 399/258 |
| 8,045,886 | B2 * | 10/2011 | Sato | 399/119 |
| 2002/0064401 | A1 * | 5/2002 | Ashikari | 399/258 |
| 2006/0210317 | A1 * | 9/2006 | Suzuki | 399/254 |

FOREIGN PATENT DOCUMENTS

JP 2004-170790 6/2004

* cited by examiner

*Primary Examiner* — Quana M Grainger
(74) *Attorney, Agent, or Firm* — Kubotera & Associates, LLC

(57) ABSTRACT

A developer cartridge includes a developer storage portion for retaining developer. The developer storage portion includes an opening portion. The developer cartridge further includes a shutter member for opening and closing the opening portion; and a first protrusion portion disposed on at least one of end portions of the developer storage portion in a longitudinal direction thereof. The first protrusion portion extends outwardly in the longitudinal direction.

21 Claims, 26 Drawing Sheets

TONER CARTRIDGE WITH PROTRUSION PORTION AND IMAGE FORMING APPARATUS

BACKGROUND OF THE INVENTION AND RELATED ART STATEMENT

The present invention relates to a developer cartridge and an image forming apparatus.

Conventionally, in an image forming apparatus such as a printer, a copier, a facsimile, a MFP (Multi-functional Product), and the likes, for example, in a printer using an electrophotographic process, a photosensitive drum, a charging roller, a developing roller, a cleaning device, and the like, are integrally formed in an image forming unit (process cartridge) to improve maintenance property. Further, the image forming unit is provided to be attachable to and detachable from a main body of the printer; that is, an apparatus main body.

Specifically, in a color printer, a capacity of toner is limited due to a size of the printer. Further, it is required to store toner in a plurality of colors in a limited space. Accordingly, a toner cartridge is provided attachable to and detachable from a main body of an image forming unit while toner is contained in the toner cartridge. Further, the toner cartridge is replaced as toner is consumed. The toner cartridge is provided with an engagement portion at an end portion thereof in a longitudinal direction for engaging with the image forming unit main body, so that a position of the toner cartridge is determined with respect to the image forming unit main body.

In the color printer, it is necessary to form an image with a high-definition without color shift. When an image with a high-definition without color shift is formed, it is necessary to provide parts relating to a printing operation with high dimension accuracy and assembly accuracy. Specifically, it is necessary to attach with high accuracy the image forming unit in which attachment and detachment operations are executed (refer to Patent Reference). Patent Reference Japanese Patent Publication No. 2004-170790

In the conventional printer, the toner cartridge is positioned with respect to the image forming unit main body. Accordingly, a relative position of the toner cartridge and the image forming unit main body remains unchanged. However, when rotation bodies inside the image forming unit main body such as a photosensitive drum, a developing roller, or the like rotate during a formation of an image or a printing operation, the image forming unit main body may twist, thereby lowering image quality.

In view of the problems described above, an object of the present invention is to provide an image forming unit and an image forming apparatus capable of solving the problems of the conventional printer. In the image forming unit and the image forming apparatus, it is possible to prevent a main body of an image forming unit from twisting while forming an image, thereby improving image quality.

Further objects and advantages of the invention will be apparent from the following description of the invention.

SUMMARY OF THE INVENTION

In order to attain the objects described above, according to the present invention, a developer cartridge includes a developer storage portion for retaining developer. The developer storage portion includes an opening portion. The developer cartridge further includes a shutter member for opening and closing the opening portion; and a first protrusion portion disposed on at least one of end portions of the developer storage portion in a longitudinal direction thereof. The first protrusion portion extends outwardly in the longitudinal direction.

In the present invention, the developer cartridge includes the first protrusion portion disposed on at least one of the end portions of the developer storage portion in the longitudinal direction thereof. Further, the first protrusion portion extends outwardly in the longitudinal direction. Accordingly, when the toner cartridge is attached to an image forming unit, it is possible to prevent the image forming unit from twisting. As a result, it is possible to form images on a left side and a right side with little difference. Further, it is possible to prevent a load torque of the image forming unit from increasing, and to prevent a set dimension such as an overlay amount and a space amount from changing, thereby improving image quality.

DETAILED DESCRIPTION OF PREFERRED EMBODIMENTS

Hereunder, embodiments of the present invention will be explained with reference to the accompanying drawings. In the following description, a printer will be explained as an image forming apparatus.

First Embodiment

Figure 2:
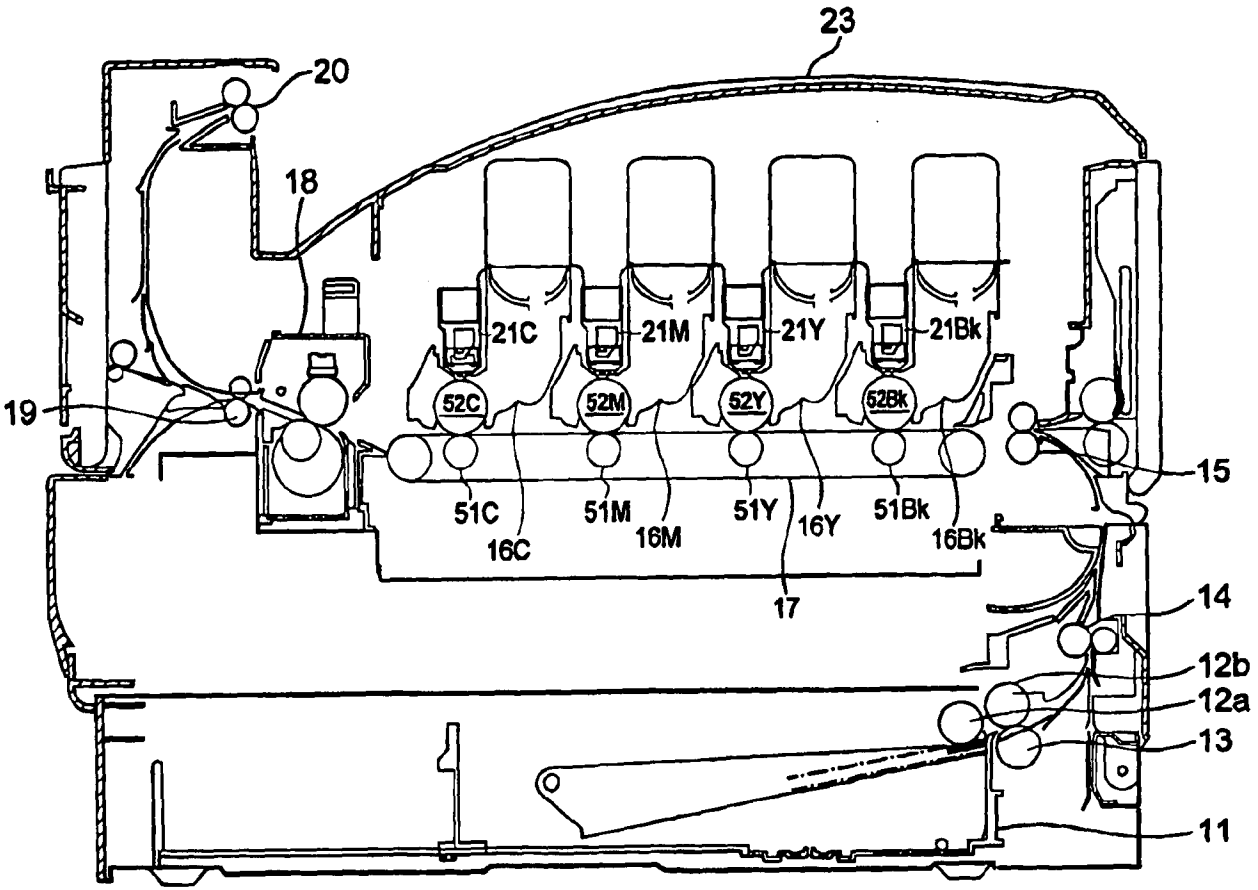
FIG. 2 is a schematic view showing the printer according to the first embodiment of the present invention.

A first embodiment of the present invention will be explained. FIG. 2 is a schematic view showing a printer according to the first embodiment of the present invention.

As shown in FIG. 2, a sheet supply cassette 11 is provided in a main body of the printer; that is, a bottom portion of the main body of the printer. The sheet supply cassette 11 is a media storage portion to accommodate a sheet (not shown) as a medium. A sheet feeding mechanism of the printer enables the sheet to be adjacent to a front edge of the sheet supply cassette 11, so that each sheet is fed separately. The sheet feeding mechanism has sheet supply rollers 12*a* and 12*b* and a separation roller 13.

In the embodiment, the sheet fed through the sheet feeding mechanism is carried to a carrying roller portion 14 provided in an upper portion. Further, the sheet is carried to a carrying roller portion 15. Then, the sheet is carried through a transfer belt 17 as the transfer belt 17 travels. The transfer belt 17 is a first transfer member and a carrying member. Further, the sheet is fed through between image forming units and transfer rollers; that is, between 16Bk and 51Bk, 16Y and 51Y, 16M and 51M, and 16C and 51C.

In the embodiment, the image forming units 16Bk, 16Y, 16M, and 16C are a plurality of image forming portions for forming a toner image as a developer image in each of black, yellow, magenta and cyan, respectively. The transfer rollers 51Bk, 51Y, 51M, and 51C are second transfer members. The transfer unit comprises the transfer belt 17, the transfer rollers 51Bk, 51Y, 51M, and 51C, and the likes.

The transfer rollers 51Bk, 51Y, 51M, and 51C transfer and overlap a toner image in each color to the sheet to form a color toner image. Photosensitive drums 52Bk, 52Y, 52M, and 52C form the toner image in each color in the image forming units 16Bk, 16Y, 16M, and 16C, respectively. The photosensitive drums 52Bk, 52Y, 52M, and 52C function as image supporting members.

Then, the sheet is carried to a fixing device 18 to fix the color toner image on the sheet and form a color image. After the sheet ejected from the fixing device 18 is carried with a carrying roller portion 19, the sheet is ejected to outside of the apparatus main body with an ejection roller portion 20.

LED heads 21Bk, 21Y, 21M, and 21C are provided adjacent to the image forming units 16Bk, 16Y, 16M, and 16C to face the photosensitive drums 52Bk, 52Y, 52M, and 52C, respectively. Each of the LED heads 21Bk, 21Y, 21M, and 21C is an exposure device. The LED heads 21Bk, 21Y, 21M, and 21C expose surfaces of the photosensitive drums 52Bk, 52Y, 52M, and 52C, respectively, to form an electrostatic latent image.

The image forming units 16Bk, 16Y, 16M, and 16C are provided to be attachable to and detachable from the apparatus main body. Accordingly, a main body cover 23 can be opened and closed on a top portion of the apparatus main body. The LED heads 21Bk, 21Y, 21M, and 21C are held with the main body cover 23.

The image forming units 16Bk, 16Y, 16M, and 16C will be explained next. The image forming units 16Bk, 16Y, 16M, and 16C have an identical configuration. Accordingly, only the image forming unit 16Bk will be explained, and explanations of the image forming units 16Y, 16M, and 16C are omitted.

Figure 3:
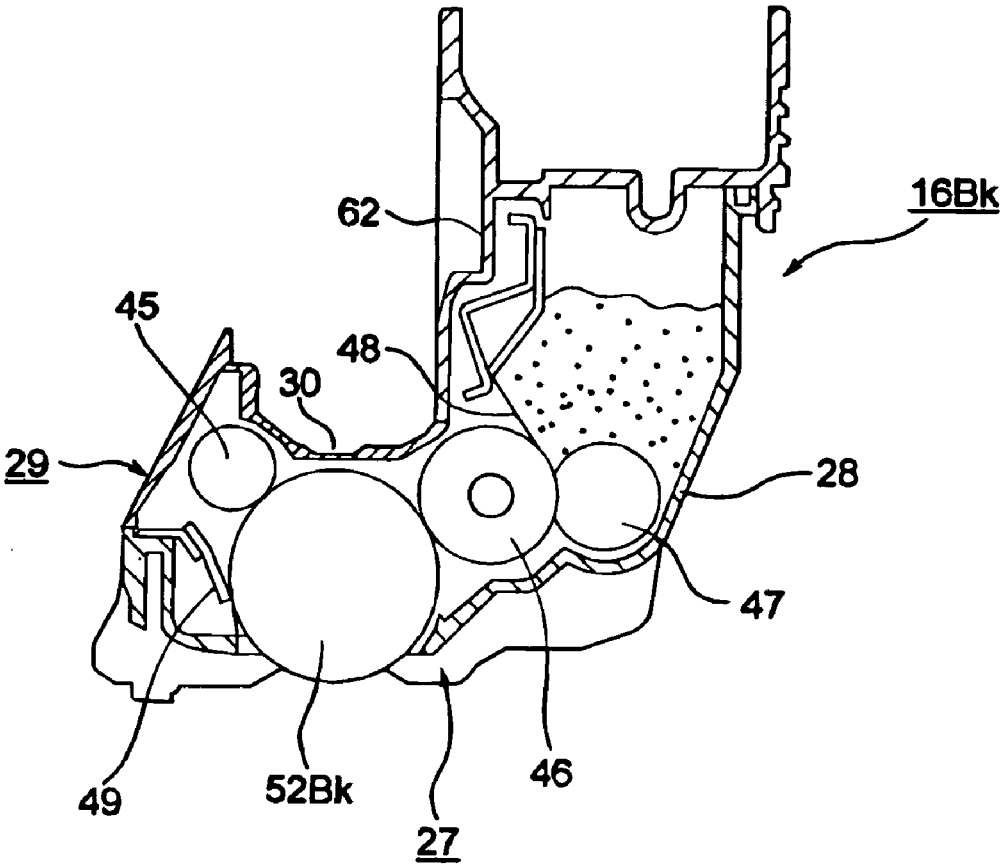
FIG. 3 is a sectional view showing the image forming unit according to the first embodiment of the present invention.

FIG. 3 is a sectional view showing the image forming unit according to the first embodiment of the present invention.

The image forming unit 16Bk is provided with the photosensitive drum 52Bk; a charging roller 45; a developing roller 46; a toner supply roller 47; a developing blade 48; and a cleaning blade 49. The charging roller 45 charges a surface of the photosensitive drum 52Bk evenly. The developing roller 46 is a developer image supporting member to hold toner as a developer. The toner supply roller 47 is a developer supply member to supply toner to the developing roller 46. The developing blade 48 is a developer regulating member to uniformly form a thin of toner on the developing roller 46. The cleaning blade 49 is a cleaning device to remove toner remaining in the photosensitive drum 52Bk after the transfer.

The photosensitive drum 52Bk comprises a conductive base layer made of aluminum or the like and a surface layer made of an organic photosensitive. The charging roller 45 is formed of a conductive metal shaft coated with a semi-conductive rubber such as epichlorohydrin rubber or the like in a roll shape. The developing roller 46 is formed of a conductive metal shaft coated with a semi-conductive rubber such as a silicone or the like. The toner supply roller 47 is formed of a conductive metal shaft coated with a rubber that is mixed with a foaming agent in order to improve a transportation property of toner.

The charging roller 45, the developing roller 46, and the cleaning blade 49 are provided to contact with the photosensitive drum 52Bk. Further, the toner supply roller 47 and the developing blade 48 are provided to contact with the developing roller 46. Power sources (not shown) of the developing roller 46, the toner supply roller 47, and the developing blade 48 are connected to the developing roller 46, the toner supply roller 47, and the developing blade 48, respectively. Accordingly, bias voltages are applied to the developing roller 46, the toner supply roller 47 and the developing blade 48, respectively.

In the embodiment, a toner cartridge (not shown) is provided to be attachable to and detachable from a main body of the image forming unit 16Bk; that is, an image forming unit main body. The toner cartridge is a developer container to accommodate toner. The image forming unit main body is provided with a housing 27. The housing 27 is provided with side housings (not shown); a bottom housing 28 as a first case; a top housing 29 as a second case; and a cover 62 as a third case.

The photosensitive drum 52Bk and the charging roller 45 are supported freely rotatably through the side housings (not shown) of the bottom housing 28 on both ends in an axis direction. Further, the developing roller 46, the toner supply roller 47, and the developing blade 48 constitute a development device, and are supported through the side housings on both ends in the axis direction.

In the embodiment, the LED head 21Bk is provided to be adjacent to the image forming unit 16Bk (FIG. 2). An opening 30 for exposure is formed in the top housing 29, so that light emitted from the LED head 21Bk is irradiated a surface of the photosensitive drum 52Bk in a downstream side of the charging roller 45 in a rotational direction (rotational direction when an image is formed) of the photosensitive drum 52Bk and an upstream side of the developing roller 46.

In the printer with the configuration described above, the developing roller 46 and the toner supply roller 47 are rotated counterclockwise in FIG. 3 through a driving motor (not shown) while printing. The driving motor is a driving portion for supplying the developer. The toner supply roller 47 supplies toner to the developing roller 46. Further, toner supplied to the developing roller 46 is carried to a contact portion of the developing roller 46 and the developing blade 48 as the developing roller 46 rotates. The developing blade 48 scrapes off excess toner to be in a thin film, and the thin film is carried to the photosensitive drum 52Bk as the developing roller 46 rotates.

In the embodiment, the photosensitive drum 52Bk is rotated in a specific direction (clockwise in FIG. 3) through driving a drum monitor (not shown) that is a driving portion for forming an image. A surface of the photosensitive drum 52Bk is charged evenly through the charging roller 45 as the photosensitive drum 52Bk rotates, and is exposed through the LED head 21Bk (FIG. 2) to form an electrostatic latent image. Further, a toner image is formed through statically adhering toner on the developing roller 46 to the electrostatic latent image.

A comparative example of the image forming unit 16Bk will be explained next.

Figure 4:
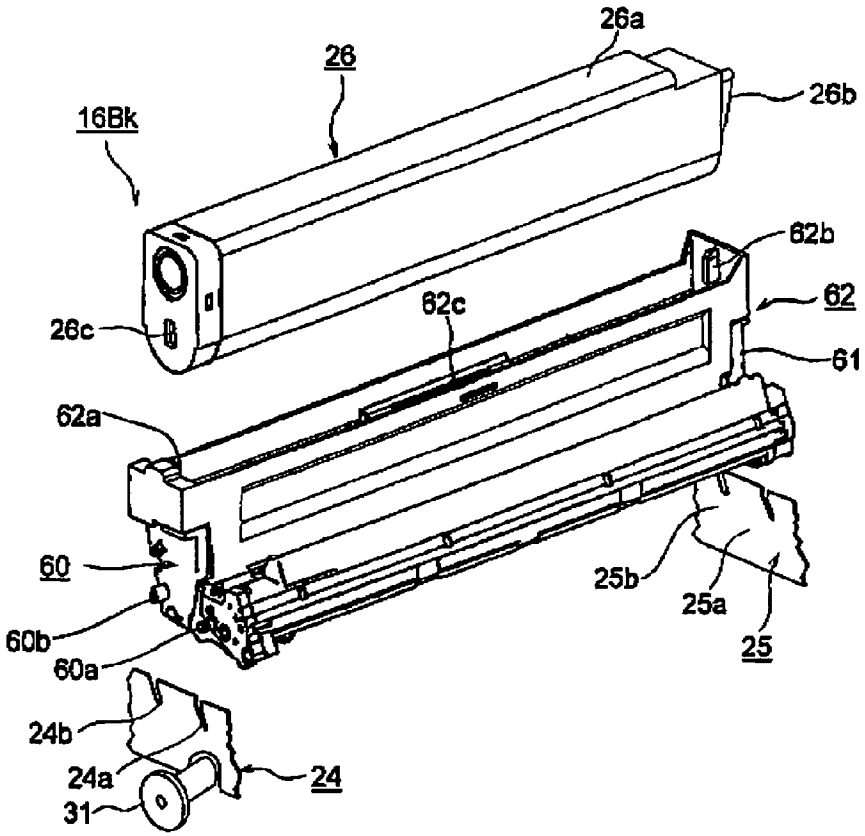
FIG. 4 CONVENTIONAL ART
FIG. 4 is an exploded perspective view showing an image forming unit according to a comparative example.
Figure 5:
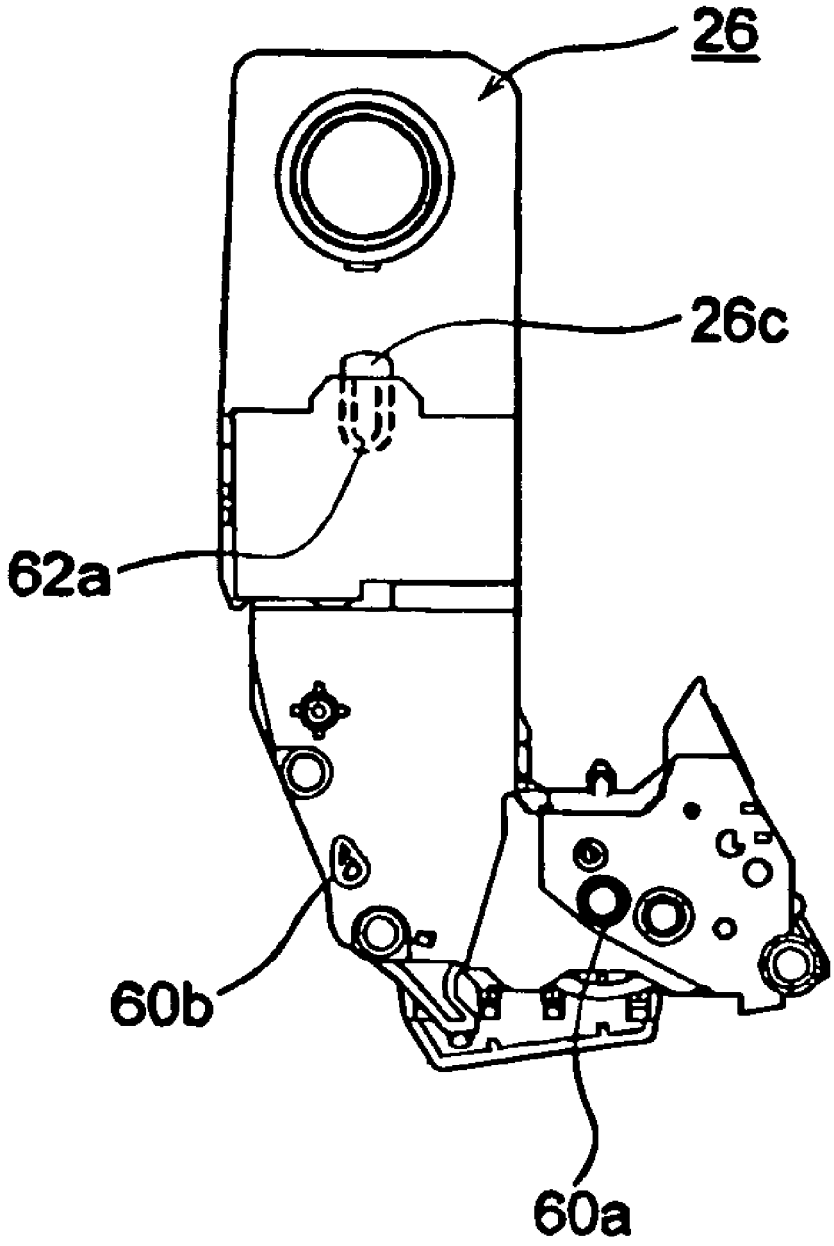
FIG. 5 is a view showing a left side surface portion of the image forming unit according to the comparative example.
Figure 6:
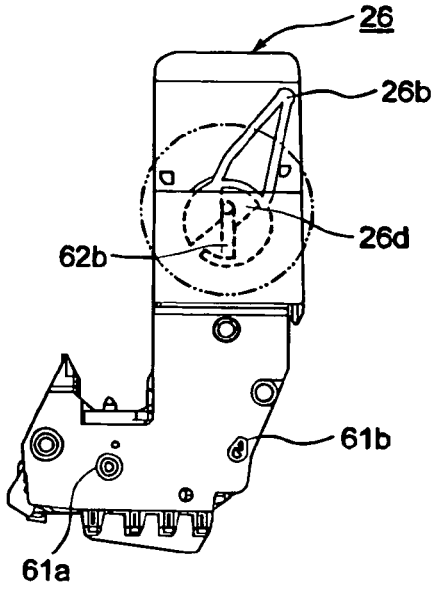
FIG. 6 is a view showing a right side surface portion of the image forming unit according to the comparative example.
Figure 7:
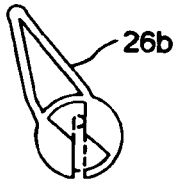
FIG. 7 is a view showing a lever in an unlocked state according to the comparative example.
Figure 8:
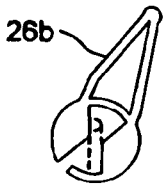
FIG. 8 is a view showing the lever in a locked state according to the comparative example.

FIG. 4 is an exploded perspective view showing the image forming unit according to the comparative example. FIG. 5 is a view showing a left side surface portion of the image forming unit according to the comparative example. FIG. 6 is a view showing a right side surface portion of the image forming unit according to the comparative example. FIG. 7 is a view showing a lever in an unlocked state according to the comparative example. FIG. 8 is a view showing the lever in a locked state according to the comparative example.

As shown in FIG. 4, in the image forming unit 16Bk, side housings 60 and 61 as a pair of supporting members are provided on both end portions (right end portion and left end portion with respect to a sheet transportation direction) of the image forming unit main body. The main members such as the photosensitive drum 52Bk, the developing roller 46, the toner supply roller 47, and the likes are rotatable or fixed to be held at a specific position through the side housings 60 and 61 while securing a specific amount of nip.

In the comparative example, the side housings 60 and 61 are provided with two pairs of protrusion portions 60*a* and 60*b*, and 61*a* and 61*b*, to determine positions thereof with respect to the apparatus main body through protruding toward outside of the image forming unit 16Bk. Further, the cover 62 as a housing is provided between the side housings 60 and 61. Moreover, the cover 62 is provided with an opening portion 62*c* to supply toner from a toner cartridge 26 to inside of the image forming unit main body. Further, walls of both ends of the cover 62 are provided with protrusion portions 62*a* and 62*b*, respectively, to fix the toner cartridge 26 to the image forming unit main body. The protrusion portions 62*a* and 62*b* are integrally formed inwardly in the cover 62.

The toner cartridge 26 is provided with a discharge port (not shown), a housing 26*a*, a lever 26*b*, and a shutter (not shown), and the likes. The discharge port is provided for discharging toner. The housing 26*a* having a box shape and an open-end portion is provided for storing toner. The lever 26*b* is provided outside the toner cartridge 26. The shutter is provided for opening and closing the discharge port, and is interlocked with the lever 26*b* to be rotated. Fitting portions 26*c* and 26*d* to fit with the protrusion portions 62*a* and 62*b* provided in the cover 62, respectively, are provided on side surfaces of the toner cartridge 26.

As described above, the toner cartridge 26 is attached to the image forming unit main body in a state in which the protrusion portions 62*a* and 62*b* and the fitting portions 26*c* and 26*d* are fitted into each other, respectively. Further, as shown in FIGS. 7 and 8, the toner cartridge 26 is fixed to the image forming unit main body through rotating the lever 26*b*.

In the comparative example, two pairs of grooves 24*a* and 24*b*, and 25*a* and 25*b* are provided in a pair of fixed walls 24 and 25 provided in the apparatus main body, respectively. The image forming unit 16Bk can be attached to a specific position of the apparatus main body through fitting the protrusion portions 60*a*, 60*b*, 61*a*, and 61*b* into the grooves 24*a*, 24*b*, 25*a*, and 25*b*.

After the image forming unit 16Bk is attached to the apparatus main body, the main body cover 23 (FIG. 2) is closed. An urging member (not shown) is provided in the main body cover 23 for urging the image forming unit 16B downwardly to prevent the image forming unit 16Bk from being displaced while printing. Accordingly, the image forming unit 16Bk fixed to the apparatus main body can receive a rotation transmitted from a motor (not shown) through a driving gear 31 on one end portion and carry out a printing operation.

In the comparative example, a plurality of the rotation bodies (rollers) such as the photosensitive drum 52Bk, the charging roller 45, the developing roller 46, the toner supply roller 47, and the like is provided inside of the image forming unit 16Bk. Each of rotary shafts of the rotation bodies is parallel to the other rotary shafts, and contacts with the other rotation bodies in one or two points. The both ends of each of the rotation bodies are supported through the side housings 60 and 61.

In the comparative example, the side housings 60 and 61 are connected through the bottom housing 28 (FIG. 3) and the top housing 29 (FIG. 3). Further, the rotation bodies are surrounded by the external housing 27 (FIG. 3) that is formed of a plate member made of a resin. The bottom housing 28 and the top housing 29 have plate shapes to avoid the rotation bodies. Accordingly, the bottom housing 28 and the top housing 29 have small resistance against twisting.

As a result, when the rotation bodies rotate during the printing operation, the image forming unit 16Bk is twisted through a frictional resistance of the contact portions of the rotation bodies. Accordingly, images formed on a right side and a left side may become uneven. Further, a load torque of the image forming unit 16Bk can be increased. In addition, a setup dimension of an overlay amount, a space amount, and the likes, can be varied. Accordingly, image quality will be deteriorated.

To this end, a reinforcing rib may be formed inwardly on the bottom housing 28, the top housing 29, or an inner circumferential surface of the bottom housing 28 or the top housing 29. In this case, the reinforcing rib and the rotation bodies contact each other. Further, the reinforcing rib may be formed outwardly. In this case, a size of the image forming unit 16Bk becomes large.

Further, a dimension variance at an engagement portion of the apparatus main body and the image forming unit 16Bk can be made small to prevent the image forming unit 16Bk from twisting. However, when the dimension difference at the engagement portion is made small, a protrusion of the image forming unit 16Bk side can be caught on the apparatus main body side. Thus, the image forming unit 16Bk cannot be set in a regular position with respect to the apparatus main body during up and down operation of the image forming unit 16Bk when the image forming unit 16Bk is attached to or detached from the apparatus main body. Accordingly, image quality will be deteriorated.

In view of the problem of the comparative example, in the first embodiment, the image forming unit 16Bk is fitted to the toner cartridge 26 through a specific fitting configuration, so that the image forming unit 16Bk does not twist in a large extent.

Figure 1:
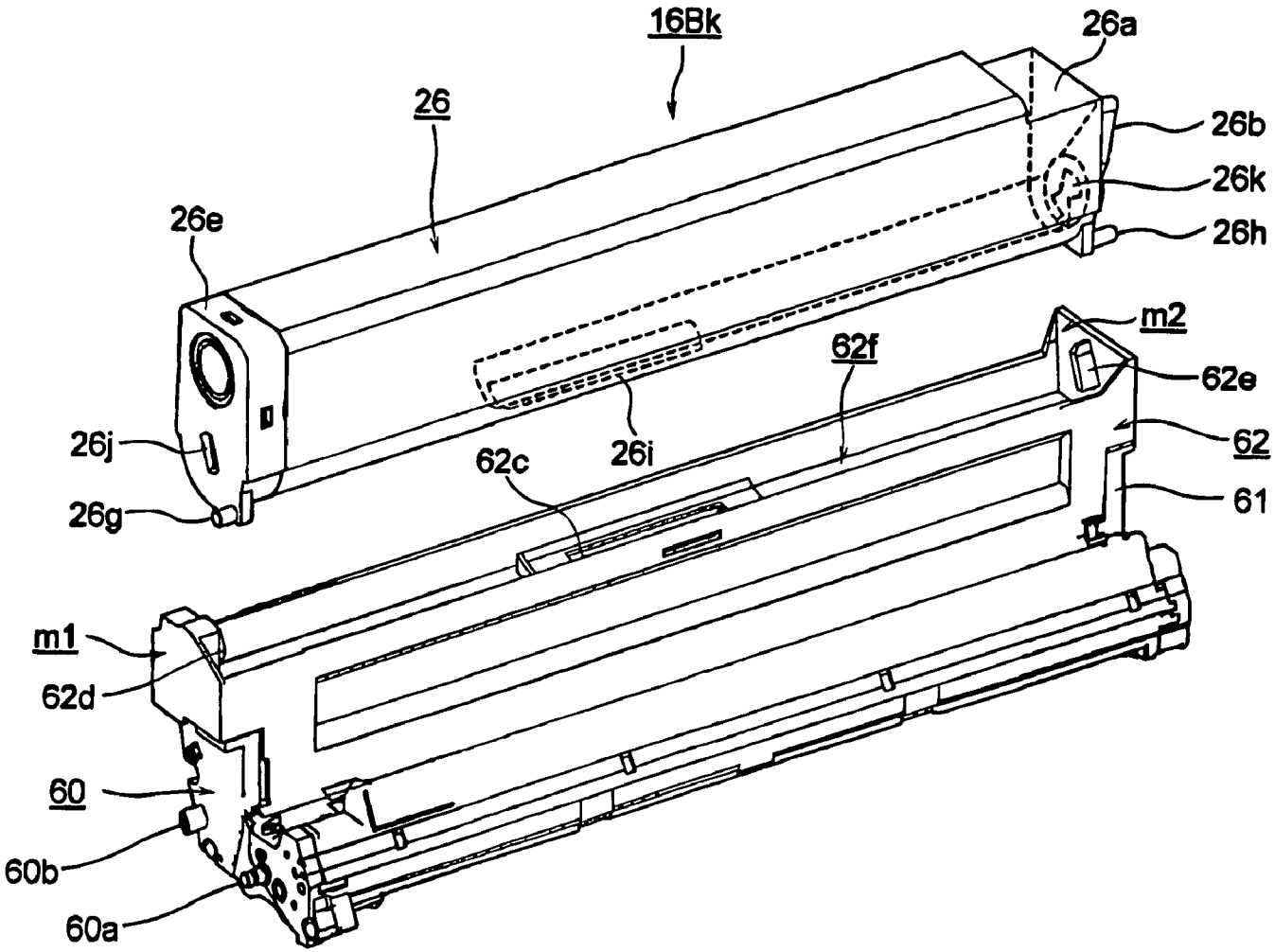
FIG. 1 is an exploded perspective view showing an image forming unit according to a first embodiment of the present invention.
Figure 9:
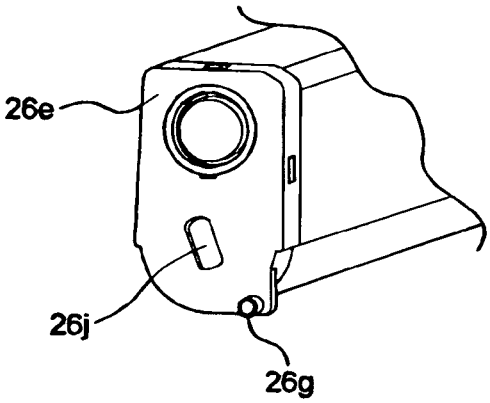
FIG. 9 is a perspective view No. 1 showing a main portion of a toner cartridge according to the first embodiment of the present invention.
Figure 10:
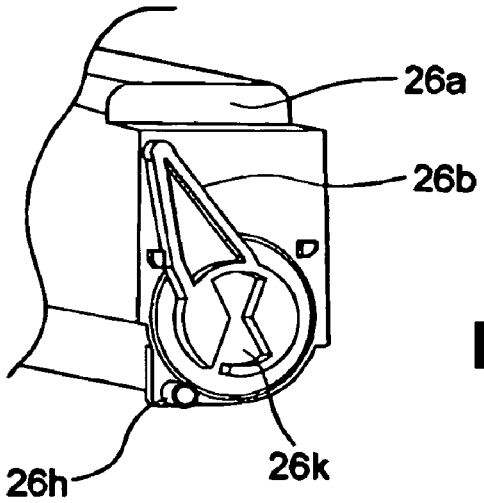
FIG. 10 is a perspective view No. 2 showing the main portion of the toner cartridge according to the first embodiment of the present invention.

FIG. 1 is an exploded perspective view showing the image forming unit according to the first embodiment of the present invention. FIG. 9 is a perspective view No. 1 showing a main portion of the toner cartridge according to the first embodiment of the present invention. FIG. 10 is a perspective view No. 2 showing the main portion of the toner cartridge according to the first embodiment of the present invention.

Figure 11:
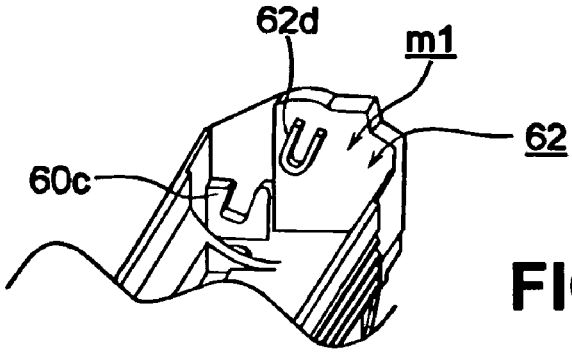
FIG. 11 is a perspective view No. 1 showing a main portion of the image forming unit main body according to the first embodiment of the present invention.
Figure 12:
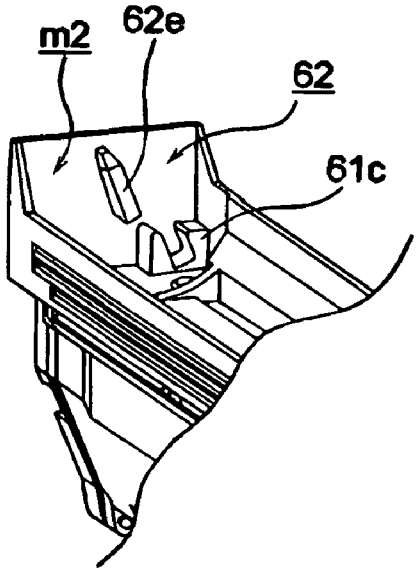
FIG. 12 is a perspective view No. 2 showing the main portion of the image forming unit main body according to the first embodiment of the present invention.
Figure 13:
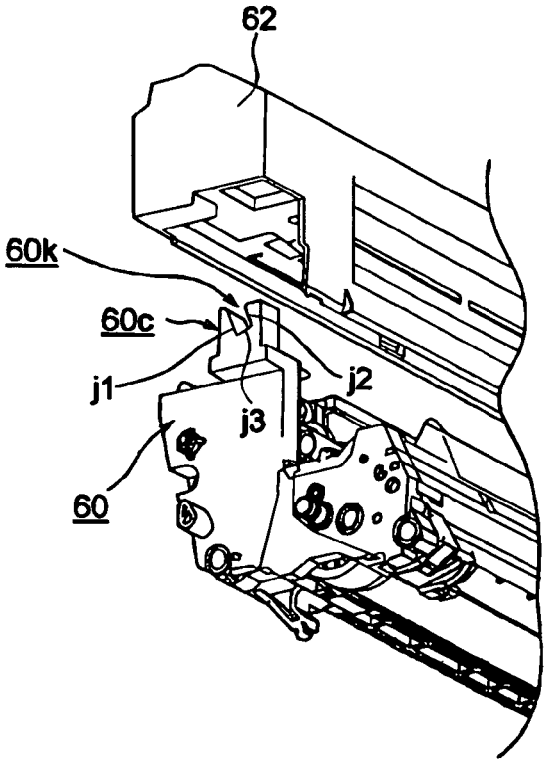
FIG. 13 is an exploded perspective view No. 1 showing a structure of a regulating groove member according to the first embodiment of the present invention.
Figure 14:
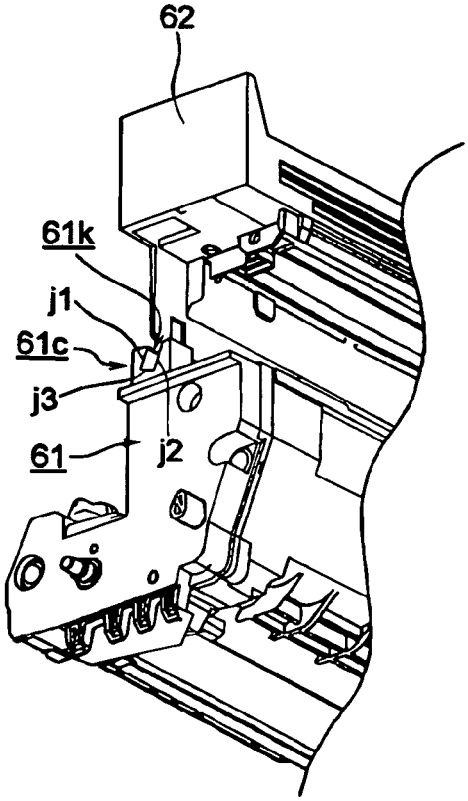
FIG. 14 is an exploded perspective view No. 2 showing the structure of the regulating groove member according to the first embodiment of the present invention.
Figure 15:
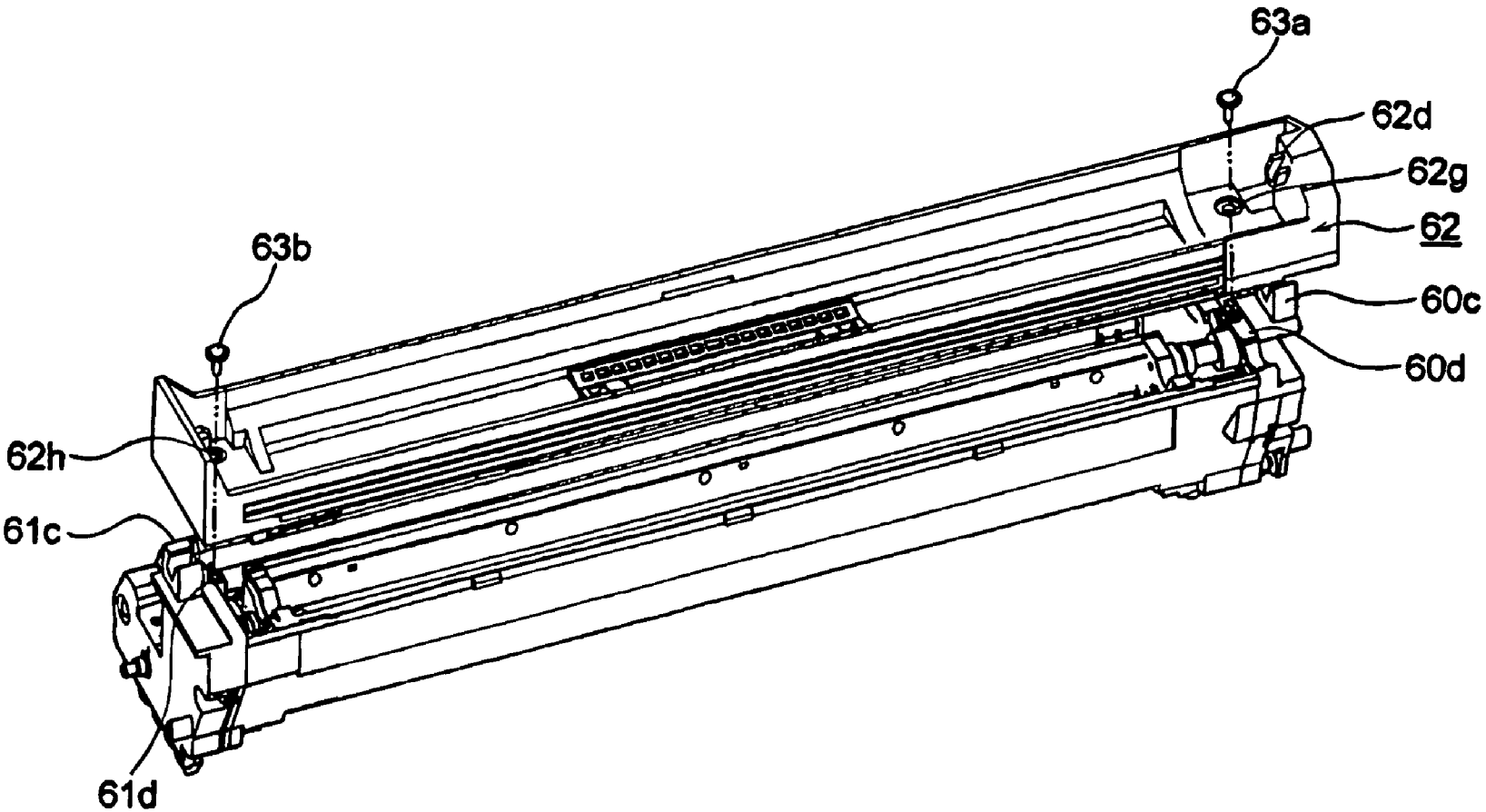
FIG. 15 is view showing a process of fixing the cover according to the first embodiment of the present invention.
Figure 16:
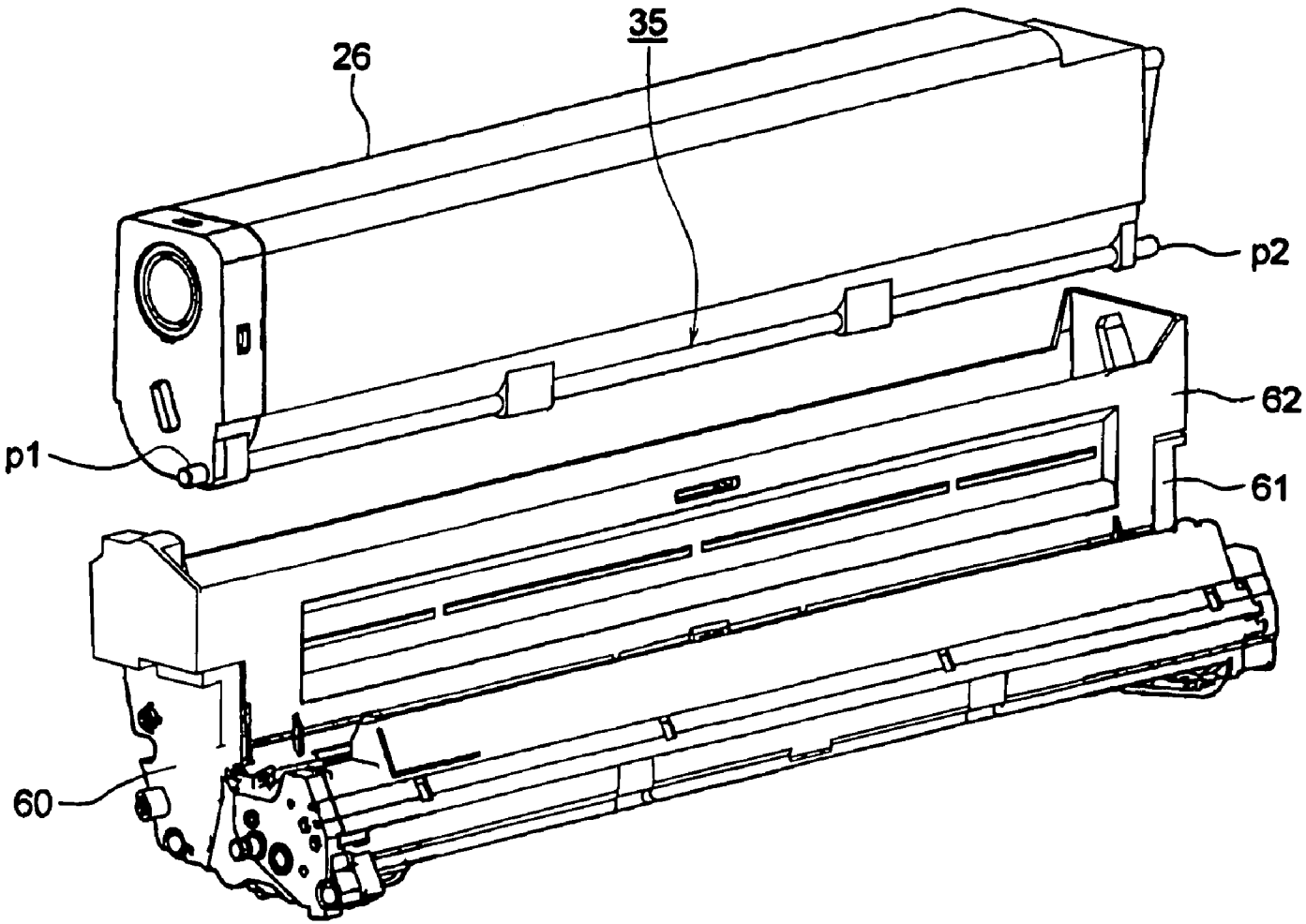
FIG. 16 is a view showing a modified example of the regulating protrusion according to the first embodiment of the present invention.

Further, FIG. 11 is a perspective view No. 1 showing a main portion of the image forming unit main body according to the first embodiment of the present invention. FIG. 12 is a perspective view No. 2 showing the main portion of the image forming unit main body according to the first embodiment of the present invention. FIG. 13 is an exploded perspective view No. 1 showing a structure of a regulating groove member according to the first embodiment of the present invention. FIG. 14 is an exploded perspective view No. 2 showing the structure of the regulating groove member according to the first embodiment of the present invention. FIG. 15 is view showing a process of fixing the cover according to the first embodiment of the present invention. FIG. 16 is a view showing a modified example of the regulating protrusion according to the first embodiment of the present invention.

As shown in FIGS. 1 and 3, both ends of the external housing 27 (FIG. 3) of the image forming unit 16Bk are provided with the side housings 60 and 61, respectively, as the supporting members. The side housings 60 and 61 support the rotation bodies to be freely rotatable. Further, the side housings 60 and 61 support the cleaning blade 49 and the like. In addition, the cover 62 is provided to surround parts held between the side housings 60 and 61.

The cover 62 is provided with a storage portion 62*f* to accommodate the toner cartridge 26. Further, when the toner cartridge 26 is attached to an inner circumference surface of sidewalls m1 and m2, fixed raised portions 62*d* and 62*e* are provided as a first engaging portion to fix the toner cartridge 26 to be integrated with the cover 62 to slope at a specific angle. The sidewalls m1 and m2 constitute both end portions of the cover 62 in an axis direction of the rotation bodies in the storage portion 62*f*.

In the embodiment, as shown in FIGS. 13 and 14, regulating groove members 60*c* and 61*c* are provided as first regulating elements near the fixed raised portions 62*d* and 62*e*, respectively. The regulating groove members 60*c* and 61*c* penetrate through the cover 62, and are integrated with the side housings 60 and 61, respectively. Further, grooves 60*k* and 61*k* that are sloped at a specific angle are provided in the regulating groove members 60*c* and 61*c*, respectively. Each of the grooves 60*k* and 61*k* comprises side surfaces j1 and j2 and a bottom surface j3. The side surfaces j1 and j2 constitute regulating surfaces.

In the embodiment, the toner cartridge 26 comprises the housing 26*a* having a box shape with one open end portion and a case having a box shape provided with a cap 26*e* to close an opening portion of the housing 26*a*. Further, the toner cartridge 26 accommodates toner therein to supply toner from a toner discharge port 26*i* provided in a center bottom portion of the housing 26*a* to the image forming unit main body. Further, a shutter (not shown) is provided for opening and closing the toner discharge port 26*i*. The shutter opens and closes the toner discharge portion 26*i* through interlocking with the lever 26*b* provided on an external edge surface of the toner cartridge 26.

In the embodiment, as shown in FIG. 15, the cover 62 is positioned through a fitting of holes 62*g* and 62*h* and protrusion portions 60*d* and 61*d*, respectively. The holes 62*g* and 62*h* are first engagement elements provided inside of the cover 62, while the protrusion portions 60*d* and 61*d* having circular shapes are second engagement elements provided integrally with the side housings 60 and 61. In the state, the cover 62 is fixed from above through screws 63*a* and 63*b* as fixing elements.

In the embodiment, fixed portions 26*j* and 26*k* having recessed shapes are provided integrally with the lever 26*b* and the cap 26*e*, respectively, on a side surface of the toner cartridge 26 upon attachment to the image forming unit 16Bk. The fixed portions 26*j* and 26*k* are second engaging portions to engage with the fixed raised portions 62*d* and 62*e*, respectively.

In the embodiment, regulating protrusions 26*g* and 26*h* having columnar shapes are formed integrally with the cap 26*e* and the housing 26*a* near the fixed raised portions 62*d* and 62*e*, respectively. The regulating protrusions 26*g* and 26*h* extend to protrude outwardly from an edge surface of the toner cartridge 26 to fit with the regulating groove members 60*c* and 61*c*, respectively, upon attachment. Further, the regulating protrusions 26*g* and 26*h* are second regulating elements to regulate rotations of the side housings 60 and 61, respectively. Outer diameters (widths) of the regulating protrusions 26*g* and 26*h* are set to be slightly smaller than widths of the grooves 60*k* and 61*k*, respectively.

In this case, it is preferred to limit sizes of certain parts so that a fitting is to be smooth and a manufacturing cost does not increase. For example, it is preferred that each of the grooves 60*k* and 61*k* has a width equal to or greater than 6.0 mm and equal to or less than 6.05 mm; each of the regulating protrusions 26*g* and 26*h* has an outer diameter equal to or greater than 5.93 mm and equal to or less than 5.98 mm. Further, it is preferred that a space equal to or greater than 0.02 mm and equal to or less than 0.12 mm is formed.

When the space is less than 0.02 mm, it is difficult to smoothly attach and detach the toner cartridge 26 to and from the image forming unit. Specifically, when toner is adhered to the regulating protrusions 26*g* and 26*h*, the regulating groove members 60*c* and 61*c*, and the likes, it is difficult to attach and detach the toner cartridge 26 to and from the image forming unit main body.

On the other hand, when the space is greater than 0.12 mm, the grooves 60*k* and 61*k* become loose with respect to the regulating groove members 60*c* are 61*c*, respectively. Accordingly, it is difficult to prevent the image forming unit 16Bk from twisting.

In the embodiment, the regulating protrusions 26*g* and 26*h* are formed integrally with the housing 26*a* and cap 26*e*, respectively, when the toner cartridge 26 is structured with relatively high rigidity. On the other hand, when the toner cartridge 26 is structured with relatively low rigidity, as shown in FIG. 16, a shaft 35 made of a metal having a circle section is provided to pierce side portions of the toner cartridge 26. A length of the shaft 35 is to be the same as the distance from a protrusion edge surface of one end to that of the other end. Accordingly, portions p1 and p2 protruded from the side surfaces of the toner cartridge 26 can be used as the regulating protrusions on both ends.

Next, a mechanism that twisting is generated in the image forming unit 16Bk will be explained.

Figure 17:
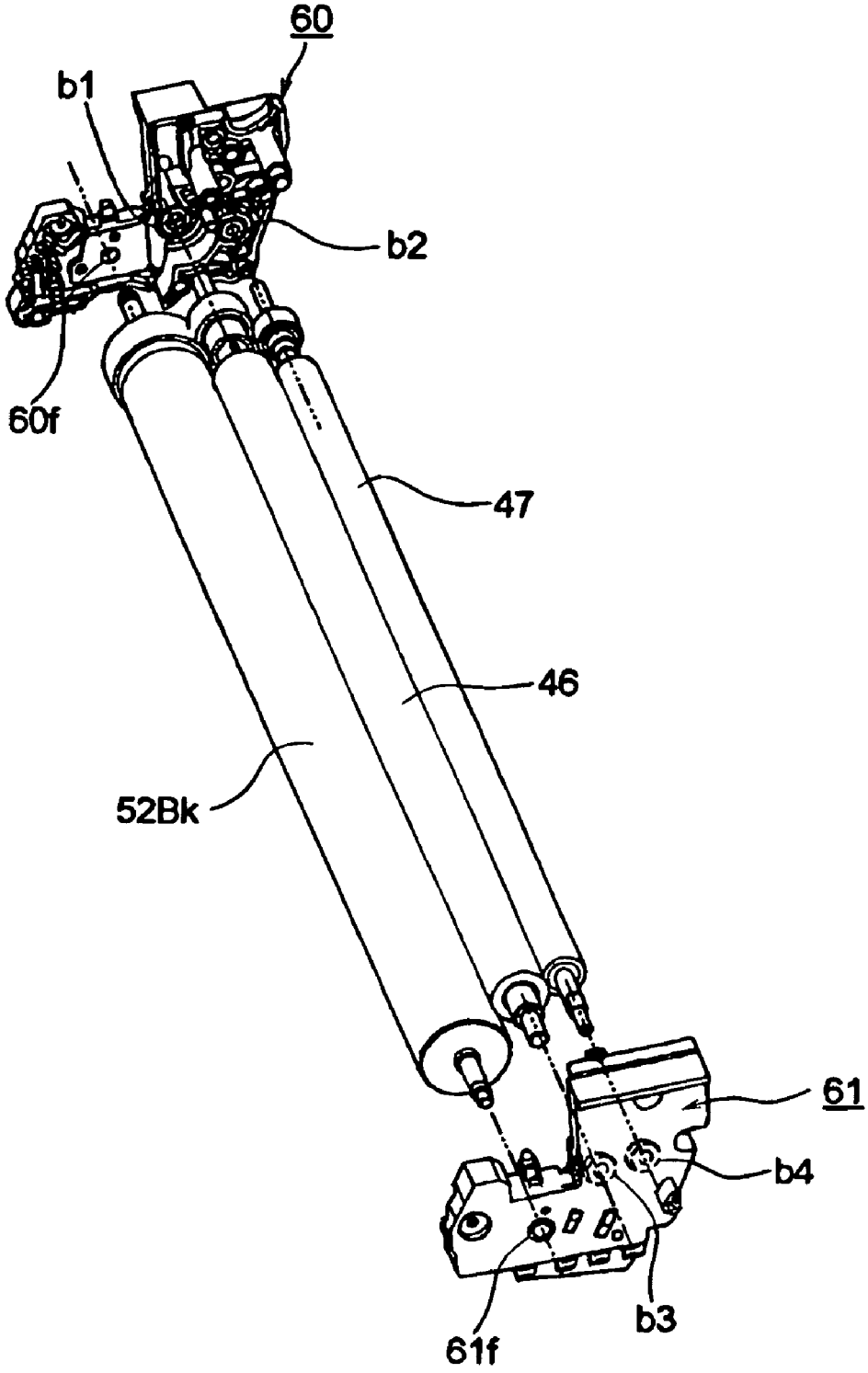
FIG. 17 is a perspective view showing a main portion of the image forming unit according to the first embodiment of the present invention.
Figure 18:
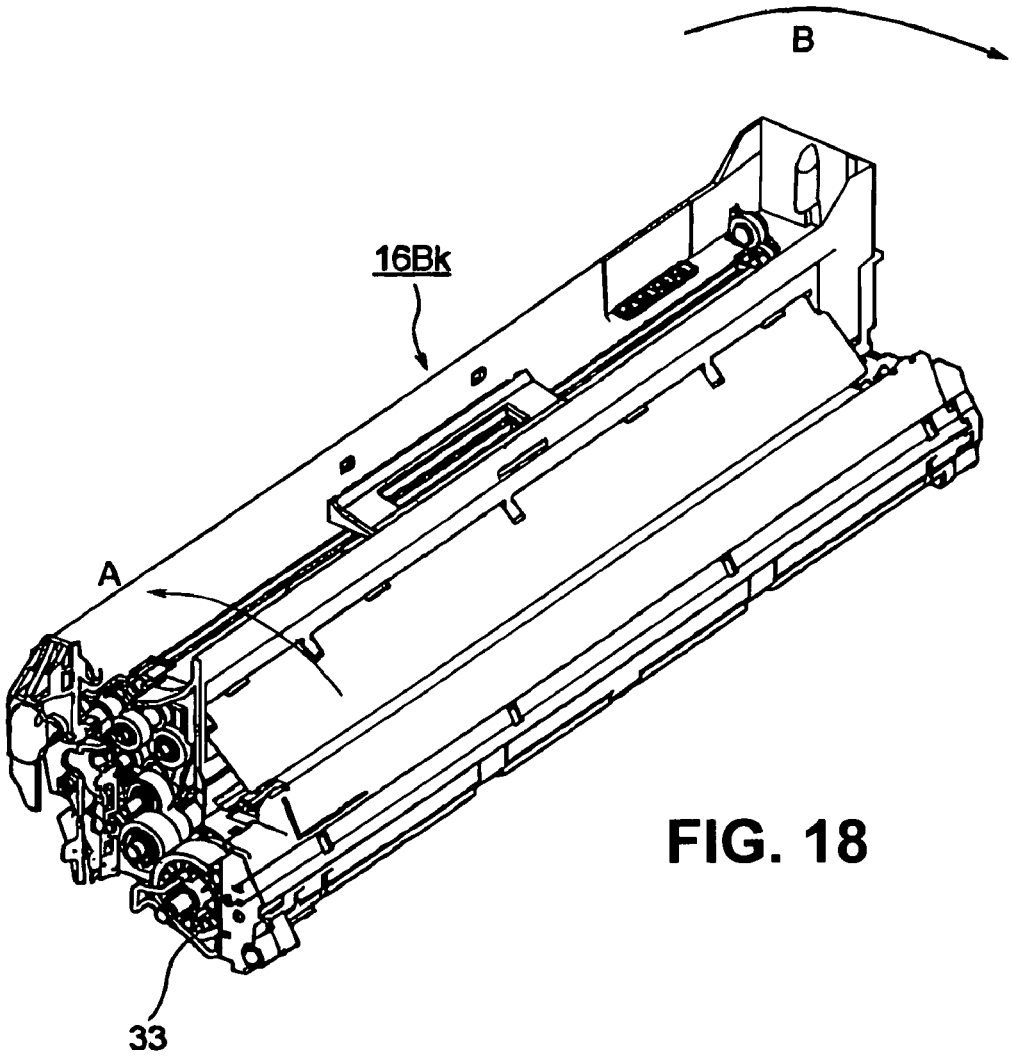
FIG. 18 is a view No. 1 for explaining a mechanism of generating twisting according to the first embodiment of the present invention.
Figure 19:
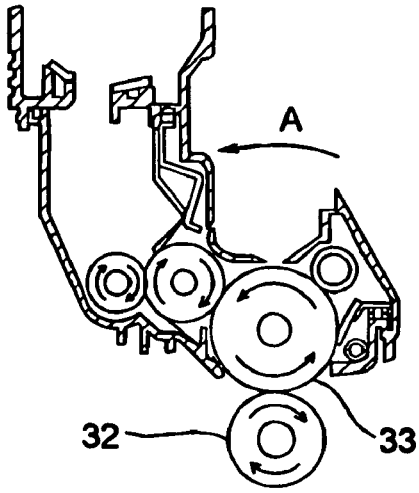
FIG. 19 is a figure No. 2 for explaining the mechanism of generating twisting according to the first embodiment.
Figure 20:
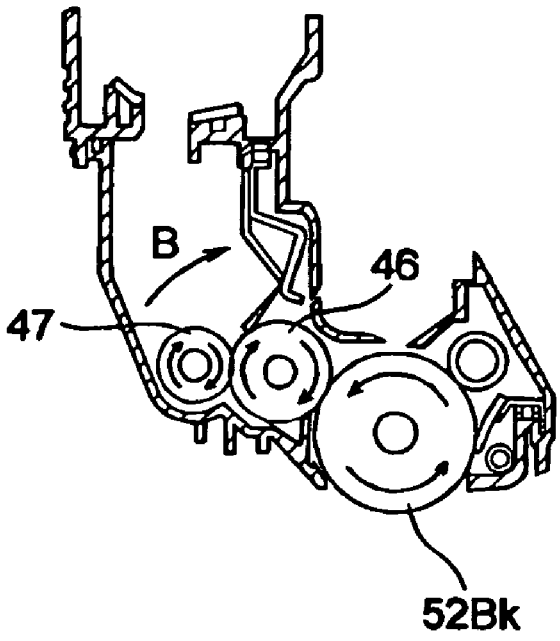
FIG. 20 is a figure No. 3 for explaining the mechanism of generating twisting according to the first embodiment.

FIG. 17 is a perspective view showing a main portion of the image forming unit according to the first embodiment of the present invention. FIG. 18 is a view No. 1 for explaining a mechanism of generating twisting according to the first embodiment of the present invention. FIG. 19 is a figure No. 2 for explaining the mechanism of generating twisting according to the first embodiment. FIG. 20 is a figure No. 3 for explaining the mechanism of generating twisting according to the first embodiment.

As shown in FIG. 17, the photosensitive drum 52Bk, the developing roller 46, and the toner supply roller 47 are provided between the side housings 60 and 61. Accordingly, shaft supporting holes 60*f* and 61*f* are provided in the side housings 60 and 61, respectively, to support the photosensitive drum 52Bk. Further, bearings b1 and b3 are provided in the side housings 60 and 61, respectively, to support the developing roller 46, while bearings b2 and b4 are provided in the side housings 60 and 61, respectively, to support the toner supply roller 47. Still further, the side housings 60 and 61 support the photosensitive drum 52Bk, the developing roller 46, and the toner supply roller to be rotatable.

In the embodiment, as shown in FIG. 18, gear rows are provided on one end portion (edge portion on right side with respect to a sheet transportation direction) of the image forming unit 16Bk, so that the rotation bodies such as the photosensitive drum 52Bk, the developing roller 46, and the toner supply roller 47 rotate. Further, a driving gear 32 for the image forming unit 16Bk is provided in the apparatus main body. As shown in FIG. 19, the driving gear 32 and a gear 33 of the gear rows are meshed.

When a rotation is transmitted to the gear 33 through the driving gear 32, the image forming unit 16Bk starts to operate. As shown in FIG. 19, a drive load of the image forming unit 16Bk itself is added to the gear 33 of the photosensitive drum 52Bk in one end portion side of the image forming unit 16Bk. Accordingly, when the photosensitive drum 52Bk rotates in a counterclockwise direction, the image forming unit 16Bk itself rotates in a direction indicated by an arrow A (counterclockwise direction).

In the embodiment, the developing roller 46 and the toner supply roller 47 contact in the same direction (clockwise direction), and are rotated at different speeds on the other end portion side of the image forming unit 16Bk. Accordingly, as shown in FIG. 20, due to the frictional resistance generated at the time, the image forming unit 16Bk itself is to be rotated in a direction indicated by an arrow B (clockwise direction). As a result, the image forming unit 16Bk is twisted.

The twisting is generated around the rotary shaft of the photosensitive drum 52Bk. Accordingly, it is effective to regulate the twisting through the regulating surfaces extending in a vertical direction with respect to the circumference direction around the rotary shaft of the photosensitive drum 52B. All of the twisting forces is regulated.

When an angle formed by the regulating surfaces with respect to a circumference direction is less than 90°, forces applied to the regulating surfaces are dispersed. Accordingly, a component parallel to the regulating surfaces is generated. As a result, positions of the side housings 60 and 61 or the regulating protrusions 26*g* and 26*h* are displaced.

In the embodiment, the regulating groove members 60*c* and 61*c* are provided in the side housings 60 and 61. The side housings 60 and 61 support the rotation bodies such as photosensitive drum 52Bk, the developing roller 46, and the toner supply roller 47 causing twisting. The regulating groove members 60*c* and 61*c* are engaged with the regulating protrusions 26*g* and 26*h* of the toner cartridge 26, respectively. Forces applied to the side housings 60 and 61 are regulated to prevent the image forming unit 16Bk from twisting.

Next, an angle to be regulated through the regulating groove members 60*c* and 61*c*; that is, a groove angle as a regulating angle will be explained.

Figure 21:
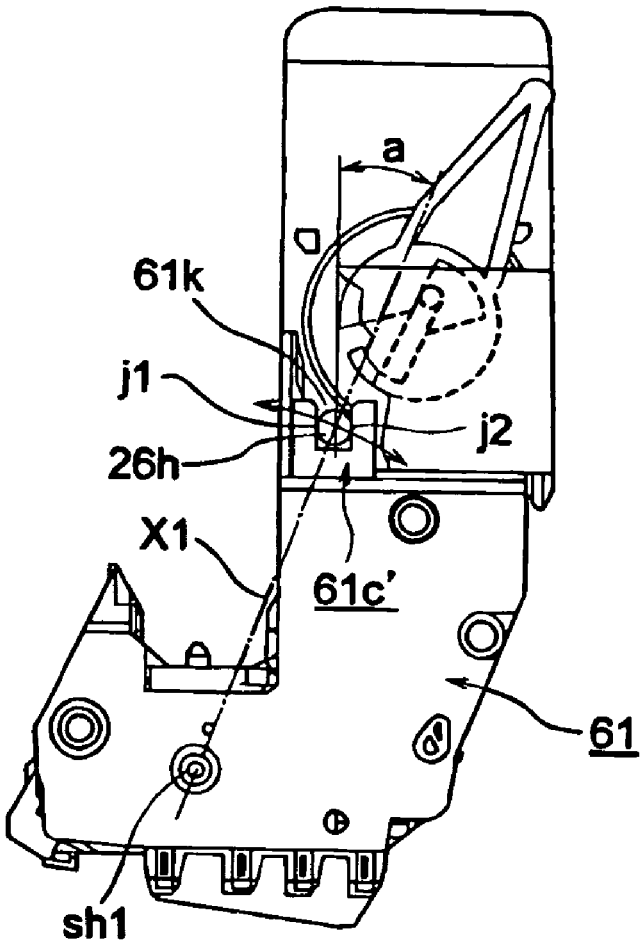
FIG. 21 is a view showing an example No. 1 of a regulating groove member according to the first embodiment of the present invention.
Figure 22:
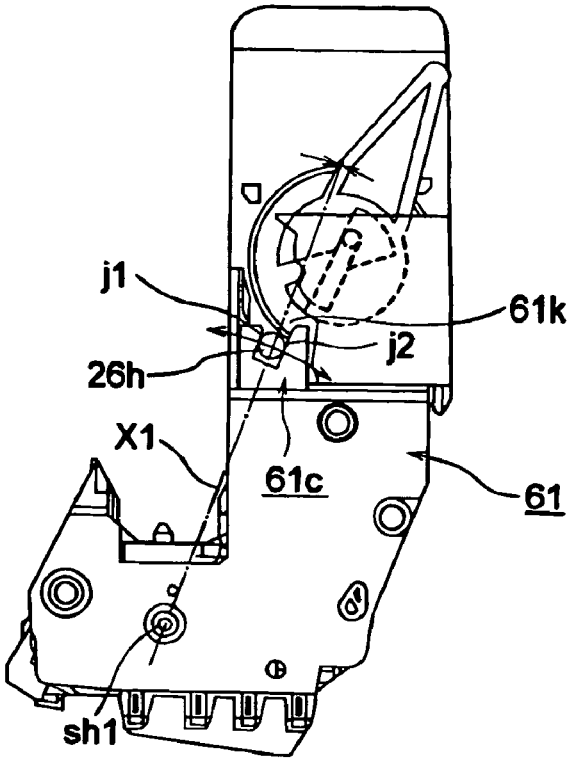
FIG. 22 is a view showing an example No. 2 of the regulating groove member according to the first embodiment of the present invention.
Figure 23:
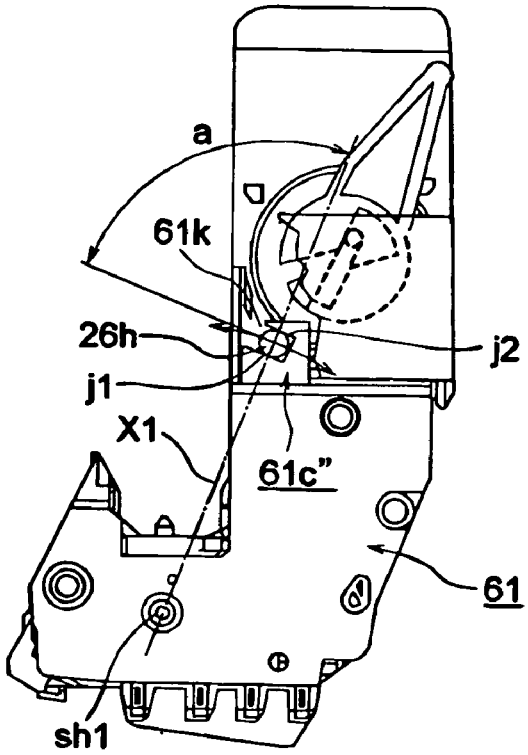
FIG. 23 is a view showing an example No. 3 of the regulating groove member according to the first embodiment of the present invention.

FIG. 21 is a view showing an example No. 1 of a regulating groove member according to the first embodiment of the present invention. FIG. 22 is a view showing an example No. 2 of the regulating groove member according to the first embodiment of the present invention. FIG. 23 is a view showing an example No. 3 of the regulating groove member according to the first embodiment of the present invention.

As shown in FIG. 21, 26*h* denotes a regulating protrusion; sh1 denotes the rotary shaft of the photosensitive drum 52Bk; and 61*c*, a 61*c*' and a 61*c*" denote regulating groove members. An angle formed by a line X1 and the side surfaces j1 and j2 is a groove angle a. The line X1 connects the rotary shaft sh1 and the regulating protrusion 26*h*. The side surfaces j1 and j2 sandwich the regulating protrusion 26*h* of the regulating groove members 61*c*, 61*c*', and 61*c*".

As shown in FIG. 21, when the side surfaces j1 and j2 of the groove 61*k* of the regulating groove member 61*c*' are formed along a vertical direction, the groove angle a has a sharp angle. As shown in FIG. 22, when the side surfaces j1 and j2 of the groove 61*k* of the regulating groove member 61*c* are provided to be parallel to the line X1, the groove angle a becomes 0°. As shown in FIG. 23, when the side surfaces j1 and j2 of the groove 61*k* of the regulating groove member 61*c*" are perpendicular to the line X1, the groove angle a becomes 90°.

It is preferred that the groove angle a is a sharp angle. When the angle a becomes closer to 0°, it is possible to reduce the twisting more effectively. That is, the twisting of the image forming unit 16Bk is generated due to a displacement caused by a rotation of the side housings 60 and 61 around the rotary shaft sh1 of the photosensitive drum 52Bk. Accordingly, it is most effective that the side surfaces j1 and j2 sandwich the regulating protrusion 26*h* from both sides in which the regulating protrusion 26*h* is provided to regulate, so that the regulating protrusion 26*h* does not move. The side surfaces j1 and j2 are provided in a direction perpendicular to a circumference direction on a circumference around the rotary shaft sh1 of the photosensitive drum 52Bk.

When the groove angle a is 90°, the regulating surface becomes parallel to a moving direction of the regulating protrusion 26*h*. Accordingly, the regulation does not work.

In the embodiment, adjacent surfaces of the fixed raised portions 62*d* and 62*e* and the fixed portions 26*j* and 26*k*, respectively, and the side surfaces j1 and j2 of the regulating groove member 61*c* are provided to be parallel to each other and in the same angle with respect to a vertical direction. Accordingly, the toner cartridge 26 can be attached to and detached from or fix to the image forming unit main body, and the image forming unit 16Bk can be attached to and detached from or fixed to the apparatus main body.

Next, an operation of the image forming unit 16Bk of the configuration will be explained.

Figure 24:
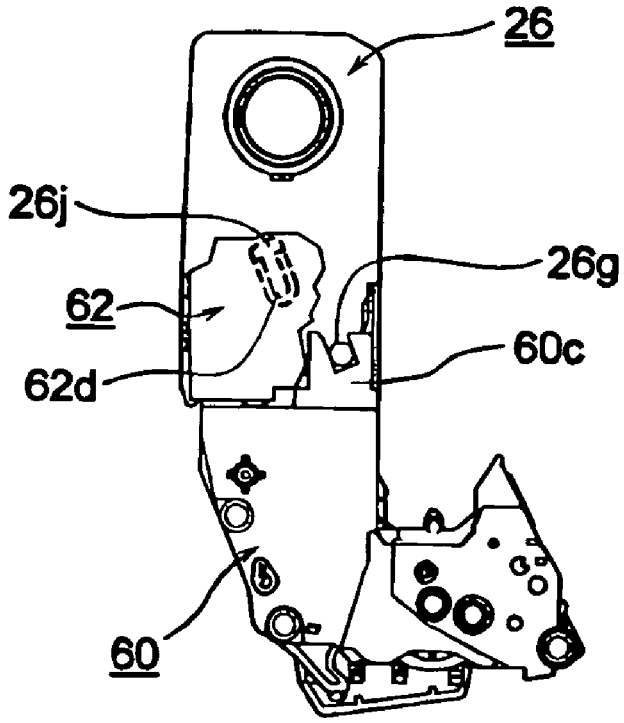
FIG. 24 is a left side view of the image forming unit according to the first embodiment of the present invention.
Figure 25:
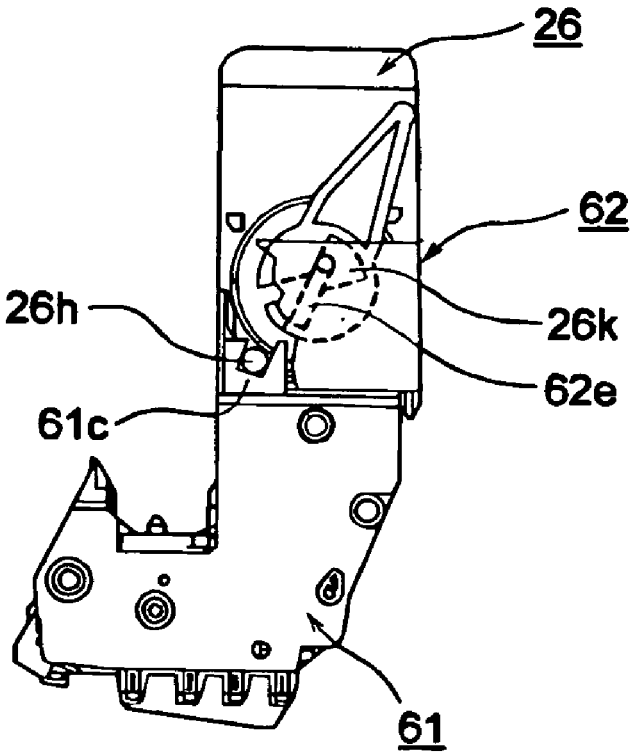
FIG. 25 is a right side view of the image forming unit according to the first embodiment of the present invention.

FIG. 24 is a left side view of the image forming unit according to the first embodiment of the present invention. FIG. 25 is a right side view of the image forming unit according to the first embodiment of the present invention.

As shown in FIG. 24, when the toner cartridge 26 is attached to the image forming unit main body, the toner cartridge 26 is inserted into the cover 62. Then, the regulating protrusions 26*g* and 26*h* of the toner cartridge 26 and the regulating groove members 60*c* and 61*c* are fitted into each other, respectively. When the lever 26*b* is rotated, the toner cartridge 26 can be fixed to the image forming unit main body.

When the printing operation is executed in this state, as described above, the image forming unit 16Bk attempts to twist. However, the regulating groove members 60*c* and 61*c* of the image forming unit main body contact the regulating protrusions 26*g* and 26*h*, respectively. The regulating protrusions 26*g* and 26*h* are supported through the rigidity of the toner cartridge 26. Accordingly, the twisting is prevented.

As described above, in the embodiment, the toner cartridge 26 is provided with the regulating protrusions 26*g* and 26*h*. Further, the regulating groove members 60*c* and 61*c* are provided in the image forming unit main body, so that the groove angle a becomes a sharp angle. Accordingly, the twisting of the image forming unit 16Bk can be prevented. Further, the images formed on right side and a left side can be even. As a result, an increase of a load torque of the image forming unit 16Bk and changes of the set dimensions of an overlay amount and a space amount are prevented. Accordingly, the image quality is improved.

Second Embodiment

A second embodiment of the present invention will be explained next. Components in the second embodiment similar to those in the first embodiment are designated with the same reference numerals. The components in the second embodiment similar to those in the first embodiment provide the same effects.

Figure 26:
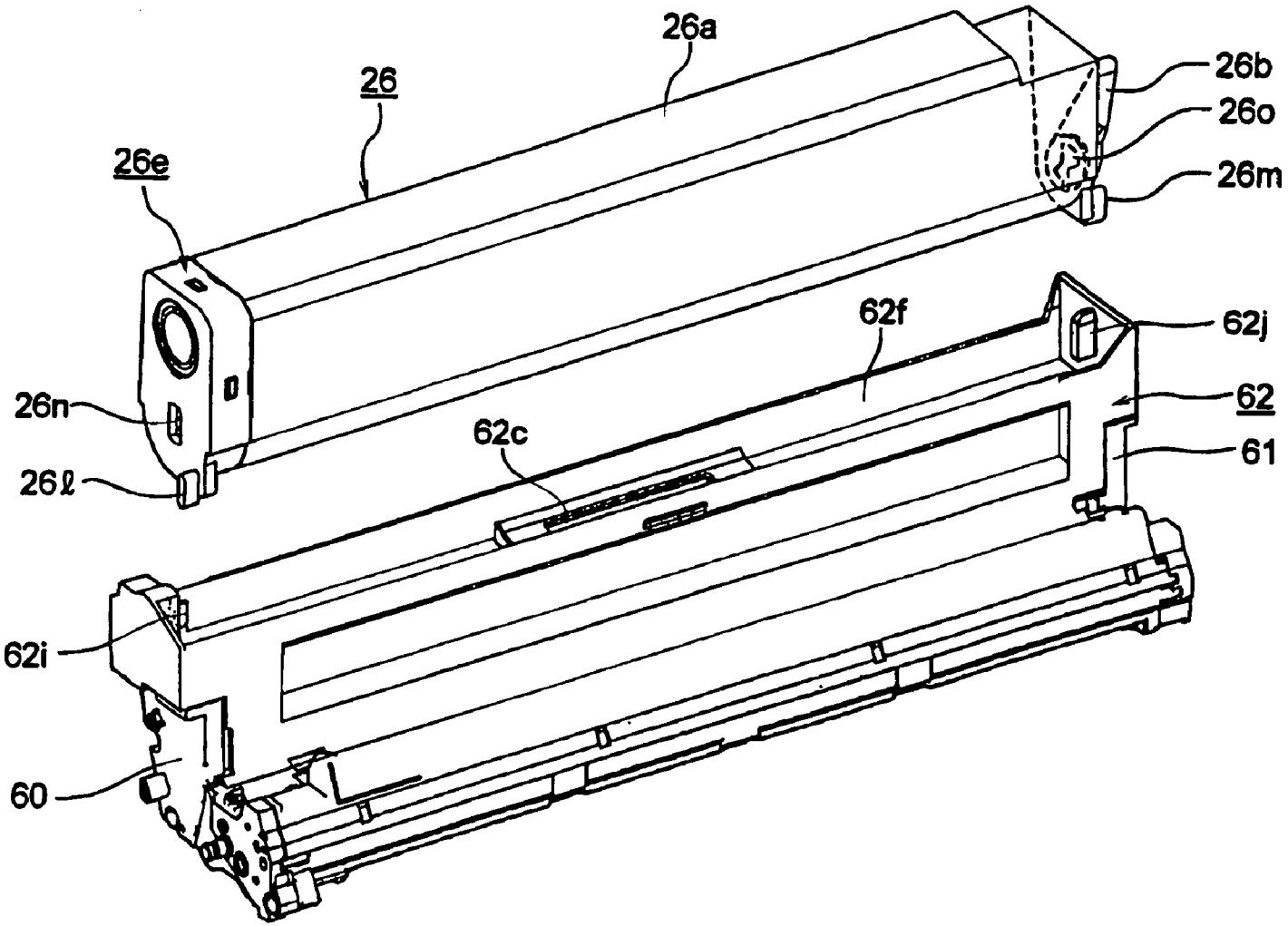
FIG. 26 is an exploded perspective view showing an image forming unit according to a second embodiment of the present invention.
Figure 27:
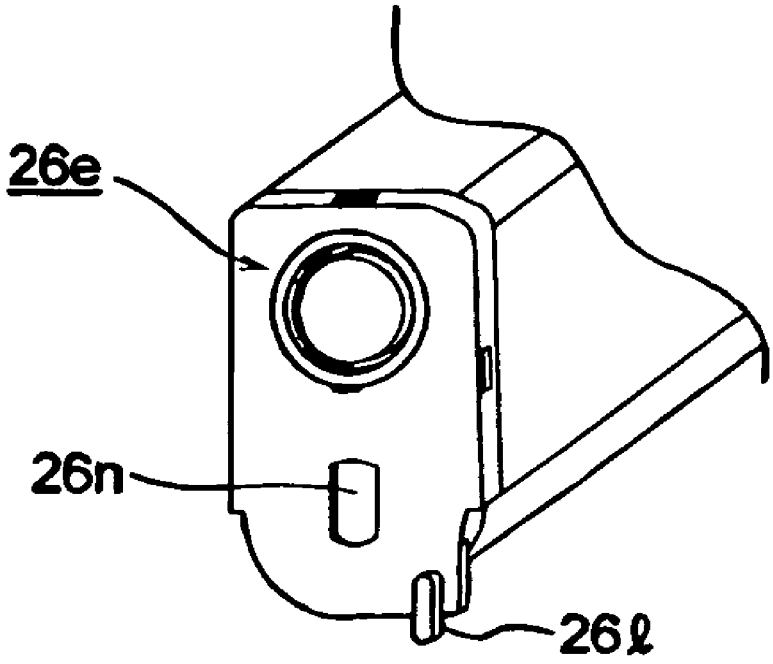
FIG. 27 is a perspective view No. 1 showing a main portion of a toner cartridge according to the second embodiment of the present invention.
Figure 28:
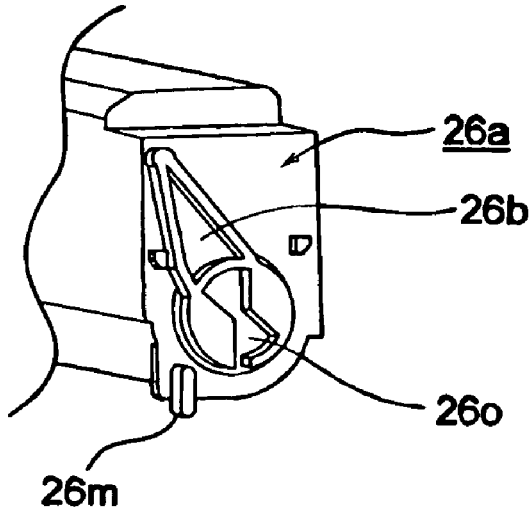
FIG. 28 is a perspective view No. 2 showing the main portion of the toner cartridge according to the second embodiment of the present invention.

FIG. 26 is an exploded perspective view showing an image forming unit according to the second embodiment of the present invention. FIG. 27 is a perspective view No. 1 showing a main portion of a toner cartridge according to the second embodiment of the present invention. FIG. 28 is a perspective view No. 2 showing the main portion of the toner cartridge according to the second embodiment of the present invention.

Figure 29:
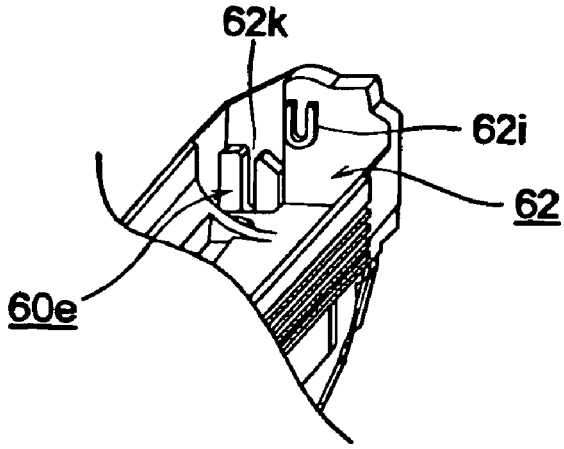
FIG. 29 is a perspective view No. 1 showing a main portion of an image forming unit main body according to the second embodiment of the present invention.
Figure 30:
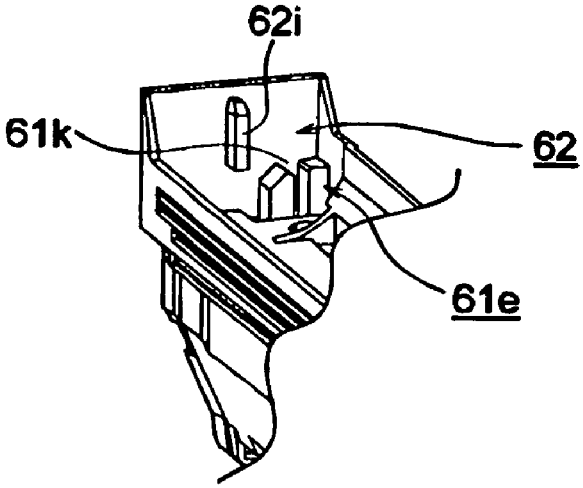
FIG. 30 is a perspective view No. 2 showing the main portion of the image forming unit main body according to the second embodiment of the present invention.
Figure 31:
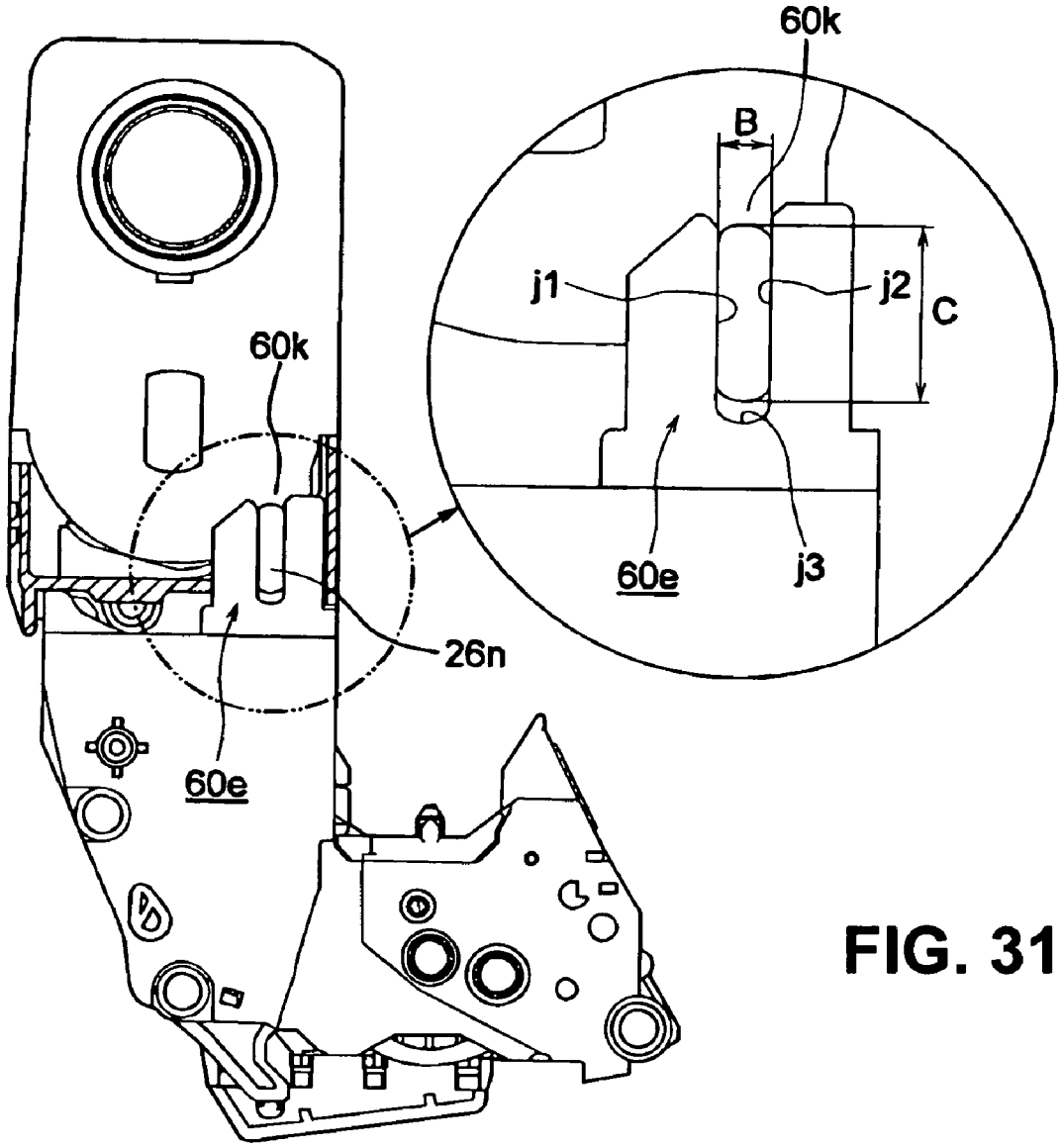
FIG. 31 is a view showing a fitting portion of a regulating protrusion and a regulating groove according to the second embodiment of the present invention.
Figure 32:
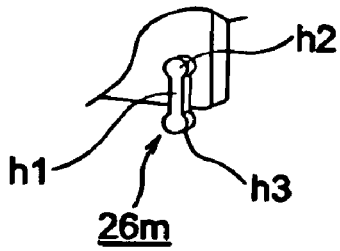
FIG. 32 is a view showing a modified example of the regulating protrusion according to the second embodiment of the present invention.

Further, FIG. 29 is a perspective view No. 1 showing a main portion of an image forming unit main body according to the second embodiment of the present invention. FIG. 30 is a perspective view No. 2 showing the main portion of the image forming unit main body according to the second embodiment of the present invention. FIG. 31 is a view showing a fitting portion of a regulating protrusion and a regulating groove according to the second embodiment of the present invention. FIG. 32 is a view showing a modified example of the regulating protrusion according to the second embodiment of the present invention.

In the embodiment, fixed raised portions 62*i* and 62*j* are provided in a vertical direction inside of the sidewalls of the both end portions of the cover 62 in a storage portion 62*f* of the image forming unit 16Bk. The fixed raised portions 62*i* and 62*j* are first engaging portions having the same shapes as those in the first embodiment.

In the embodiment, the regulating groove members 60*e* and 61*e* are provided as first regulating elements near the fixed raised portions 62*i* and 62*j* piercing the cover 62 to be integrated with the side housings 60 and 61, respectively. Further, the grooves 60*k* and 61*k* are provided in the regulating groove members 60*e* and 61*e*, respectively. Each of the grooves 60*k* and 61*k* comprises the side surfaces j1 and j2 and the bottom surface j3. Further, the regulating surfaces comprise the side surfaces j1 and j2.

In the embodiment, in the side surfaces of the toner cartridge 26, fixed portions 26*n* and 26*o* having recessed shapes are provided to be integrated with the lever 26*b* and the cap

26*e*, respectively. The fixed portions 26*n* and 26*o* are second engagement portions to fit with the fixed raised portions 62*i* and 62*j* when attached to the image forming unit main body.

Further, regulating protrusions 26*l* and 26*m* are provided to protrude from side surfaces of the toner cartridge 26 and to be integrated with the housing 26*a* and the cap 26*e*, respectively, near the fixed portions 26*n* and 26*o*. The regulating protrusions 26*l* and 26*m* are second regulating elements having rectangular column shapes in which vertical direction dimensions C are made larger than horizontal direction dimensions B (FIG. 31).

The horizontal direction dimensions B of the regulating protrusions 26*l* and 26*m* are to be slightly smaller than the widths of the grooves 60*k* and 61*k*, respectively. Further, the vertical direction dimensions C of the 26*l* and 26*m* are to be slightly smaller than the depths of the grooves 60*k* and 61*k*, respectively.

In the embodiment, fitting portions comprise the regulating groove members 60*e* and 61*e* and the regulating protrusions 26*l* and 26*m*, respectively. The regulating groove members 60*e* and 61*e* and the regulating protrusions 26*l* and 26*m* are fitted into each other. Accordingly, the side surfaces j1 and j2 of the grooves 60*k* and 61*k* of the regulating groove members 60*e* and 61*e* can regulate the side surfaces of the regulating protrusions 26*l* and 26*m* in a vertical direction, respectively.

In the embodiment, certain parts are formed in limited sizes, so that the regulating protrusions 26*l* and 26*m* can fit into the regulating groove members 60*e* and 61*e* smoothly, and the manufacturing cost does not increase. More specifically, each of the regulating protrusions 26*l* and 26*m* has the horizontal direction dimension B equal to or greater than 4.93 mm and equal to or less than 4.98 mm; each of the grooves 60*k* and 61*k* has a width equal to or greater than 5.0 mm and equal to or less than 5.05 mm. Further, a space equal to or greater than 0.02 mm and equal to or less than 0.12 mm is provided.

When the space is less than 0.02 mm, the toner cartridge 26 is difficult to smoothly attach to or detach from the image forming unit main body. Specifically, when toner is adhered to the regulating protrusions 26*l* and 26*m* or the regulating groove members 60*e* and 61*e*, the toner cartridge 26 is difficult to attach to or detach from the image forming unit main body.

On the other hand, when the space is greater than 0.12 mm, the regulating protrusions 26*l* and 26*m* become loose with respect to the regulating groove members 60*e* and 61*e*, respectively. Accordingly, the twisting of the image forming unit 16Bk is not effectively prevented.

Further, a space is formed between each lower surface of the regulating protrusions 26*l* and 26*m* and each bottom surface j3 of the regulating groove members 60*e* and 61*e*. The dimension of the space is determined considering variations of the dimensions within general tolerance according to the manufacturing method of the side housings 60 and 61, the toner cartridge 26, and the likes.

Normally, when a molded component has a dimension equal to or less than 10 mm, the general tolerance is to be plus or minus 0.2 mm. Accordingly, it is preferred that the space greater than 0.4 mm is formed, so that the regulating protrusions 26*l* and 26*m* and the regulating groove members 60*e* and 61*e*, respectively, do not contact each other.

In the embodiment, the regulating protrusions 26*l* and 26*m* do not need to be in rectangular columnar shapes, and may be in shapes having a plurality of the regulating portions. In this case, the regulating protrusions 26*l* and 26*m* have more than two regulating portions contacting with the side surfaces j1 and j2 of the grooves 60*k* or 61*k* on a point, line, surface, or the like over a distance longer than the horizontal direction dimension. For example, as shown in FIG. 32, the regulating portions h2 and h3 having circular shapes are swollen on top and bottom edges of a main body h1 to provide the regulating protrusions.

Further, in the embodiment, the regulating protrusions 26*l* and 26*m* and the grooves 60*k* and 61*k* are provided in an attachment and detachment direction of the toner cartridge 26 from the image forming unit main body or a vertical direction. The regulating protrusions 26*l* and 26*m* and the grooves 60*k* and 61*k* can be provided to be tilted by a specific angle, as far as the toner cartridge 26 can be attached to or detached form the image forming unit main body smoothly.

Next, an operation of the image forming unit 16Bk of the configuration will be explained.

Figure 33:
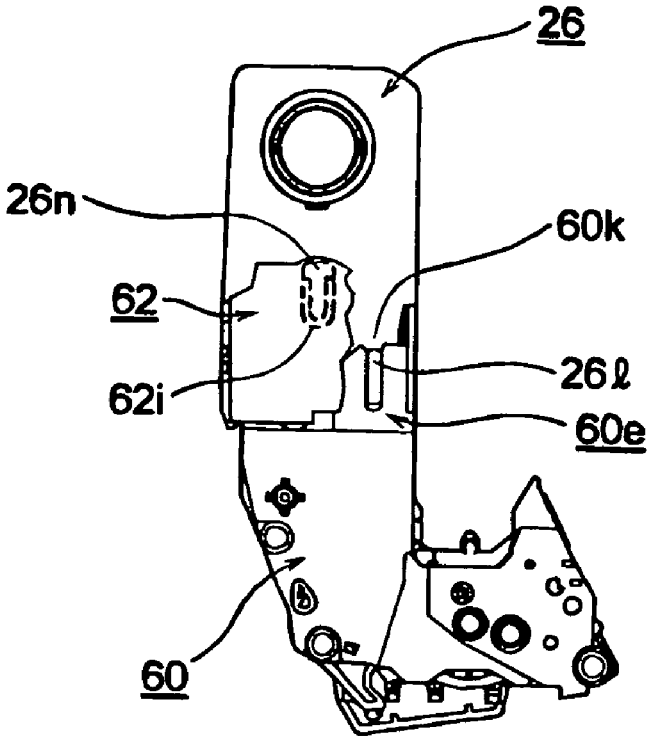
FIG. 33 is a left side view of the image forming unit according to the second embodiment of the present invention.
Figure 34:
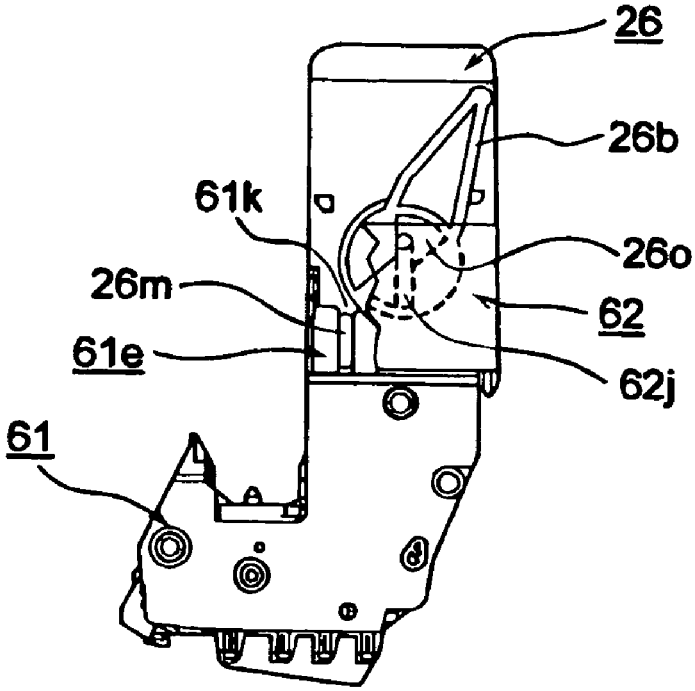
FIG. 34 is a right side view of the image forming unit according to the second embodiment of the present invention.
Figure 35:
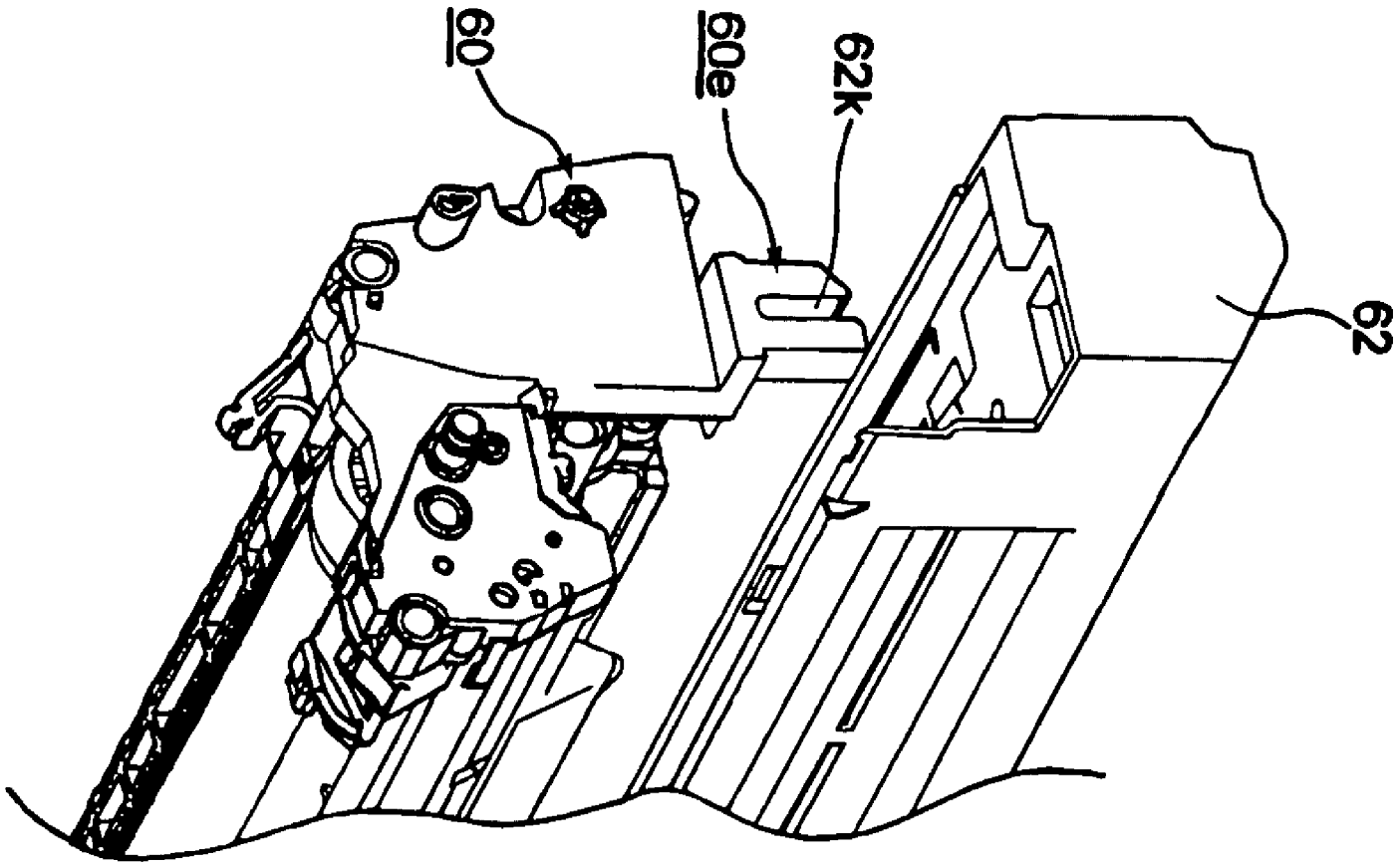
FIG. 35 is an exploded perspective view No. 1 showing a configuration of a regulating groove according to the second embodiment of the present invention.
Figure 36:
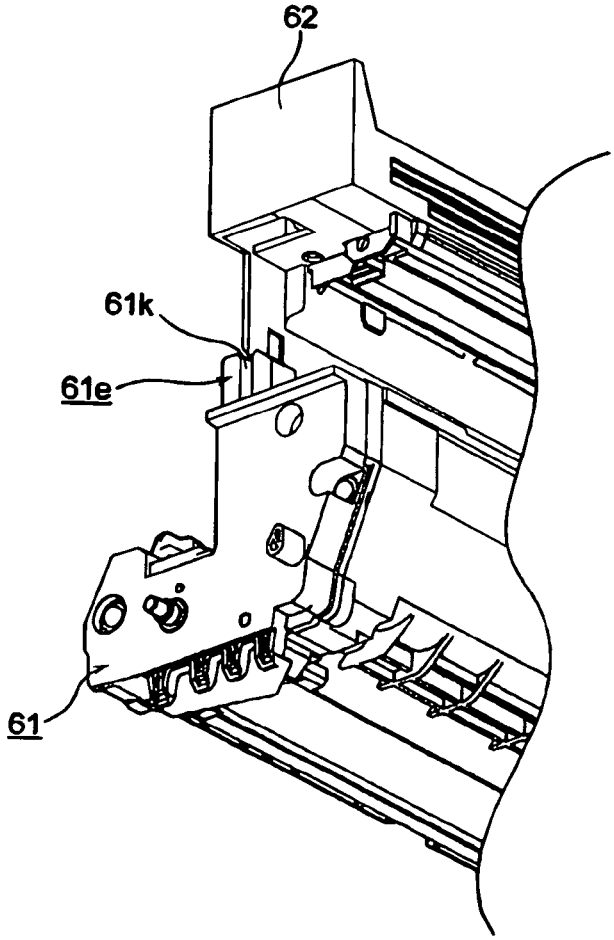
FIG. 36 is an exploded perspective view No. 2 showing the configuration of the regulating groove according to the second embodiment of the present invention.
Figure 37:
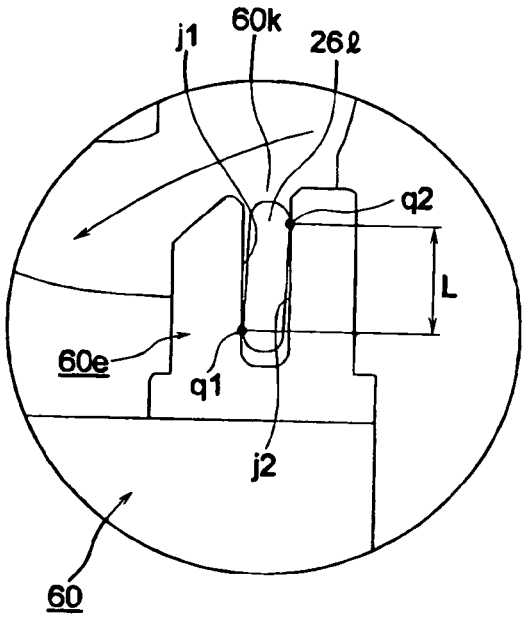
FIG. 37 is a view showing an operation of a fitting portion of a regulating protrusion and the regulating groove according to the second embodiment of the present invention.

FIG. 33 is a left side view of the image forming unit according to the second embodiment of the present invention. FIG. 34 is a right side view of the image forming unit according to the second embodiment of the present invention. FIG. 35 is an exploded perspective view No. 1 showing a configuration of the regulating groove according to the second embodiment of the present invention. FIG. 36 is an exploded perspective view No. 2 showing the configuration of the regulating groove according to the second embodiment of the present invention. FIG. 37 is a view showing an operation of a fitting portion of the regulating protrusion and the regulating groove according to the second embodiment of the present invention.

As shown in FIG. 33, when the toner cartridge 26 is attached to the image forming unit main body, the toner cartridge 26 is inserted into inside of the cover 62. Then, the regulating protrusions 26*l* and 26*m* of the toner cartridge 26 are fitted into the regulating groove members 60*e* and 61*e* inside of the cover 62, respectively. Further, when the lever 26*b* is rotated, the toner cartridge 26 can be fixed to the image forming unit main body.

At this time, in the fitting portion, the side surfaces of the regulating protrusions 26*l* and 26*m* contact with the side surfaces j1 and j2 of the grooves 60*k* and 61*k*, respectively. Accordingly, movements of the regulating protrusions 26*l* and 26*m* in a perpendicular direction with respect to the side surfaces j1 and j2 are regulated. In addition, rotations of the regulating protrusions 26*l* and 26*m* are also regulated.

That is, as shown in FIG. 37, even when the side housing 60 tries to rotate in a direction indicated by an arrow, the side surfaces of the regulating protrusion 26*l* contact with the side surfaces j1 of the groove 60*k* at points q1 and q2 separated by a distance L in a vertical direction. Accordingly, a rotation of the regulating protrusion 26*l* is regulated. When the distance L becomes larger, the twisting of the side housing 60 is regulated more effectively. A state of the contact changes in one to two points depending on the vertical direction dimension C and spaces between the regulating protrusions 26*l* and 26*m* and the grooves 60*k* and 61*k*, respectively.

When a printing operation is executed in this state, as described above, the image forming unit 16Bk attempts to twist. However, the regulating groove members 60*e* and 61*e* of the image forming unit main body contact with the regulating protrusions 26*l* and 26*m*, respectively. The regulating protrusions 26*l* and 26*m* are supported on the toner cartridge 26. Accordingly, twisting is prevented.

As described, in the embodiment, the regulating protrusion 26*l* and 26*m* are provided to protrude from the both side surfaces of the toner cartridge 26. Further, the regulating groove members 60*e* and 61*e* are provided in the side housings 60 and 61, respectively, inside of the image forming unit 16Bk. Accordingly, the twisting of the image forming unit 16Bk can be prevented. As a result, images formed on a right side and a left side can become even. Further, an increase of a load torque of the image forming unit 16Bk and changes of the set dimensions of an overlay amount and a space amount are prevented. Accordingly, image quality is improved.

Further, the two side surfaces of the regulating protrusions 26*l* and 26*m* contact with the side surfaces j1 and j2 of the grooves 60*k* and 61*k*, respectively, at two points q1 and q2. Accordingly, there are no differences in the regulating force due to angles (slopes) of the regulating protrusions 26*l* or 26*m* and the side surfaces j1 and j2. That is, the angle can be determined freely.

Third Embodiment

A third embodiment of the present invention will be explained next. Components in the third embodiment similar to those in the first and second embodiments are designated with the same reference numerals. The components in the third embodiment similar to those in the first and second embodiments provide the same effects.

Figure 38:
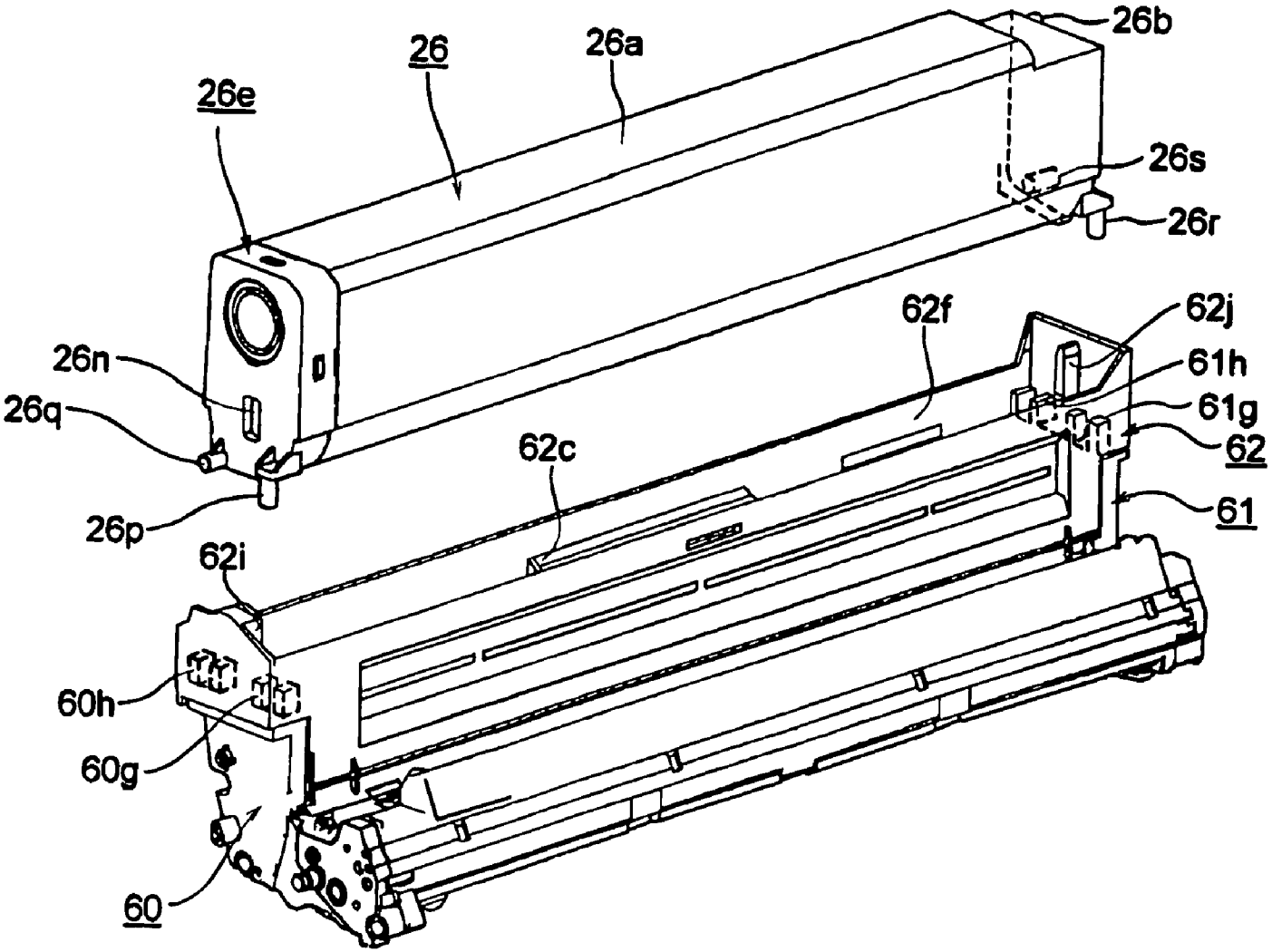
FIG. 38 is an exploded perspective view of an image forming unit according to a third embodiment of the present invention.
Figure 39:
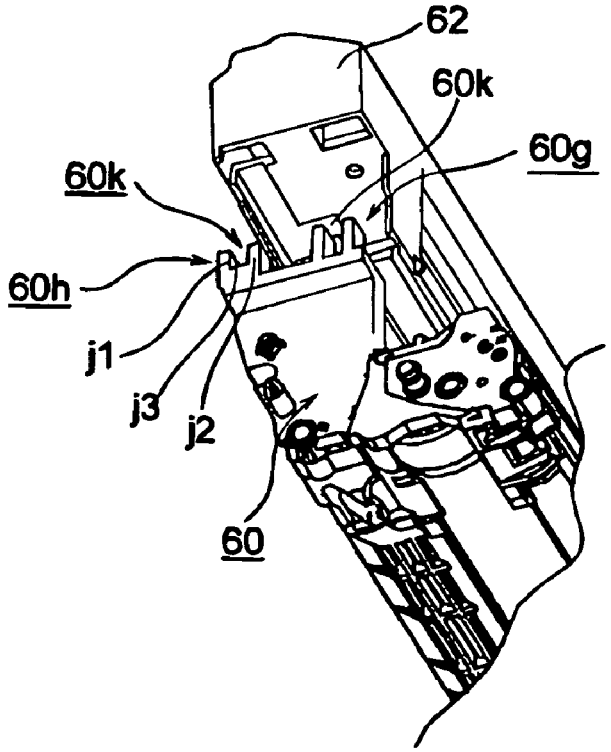
FIG. 39 is an exploded perspective view No. 1 showing a configuration of a regulating groove according to the third embodiment of the present invention.
Figure 40:
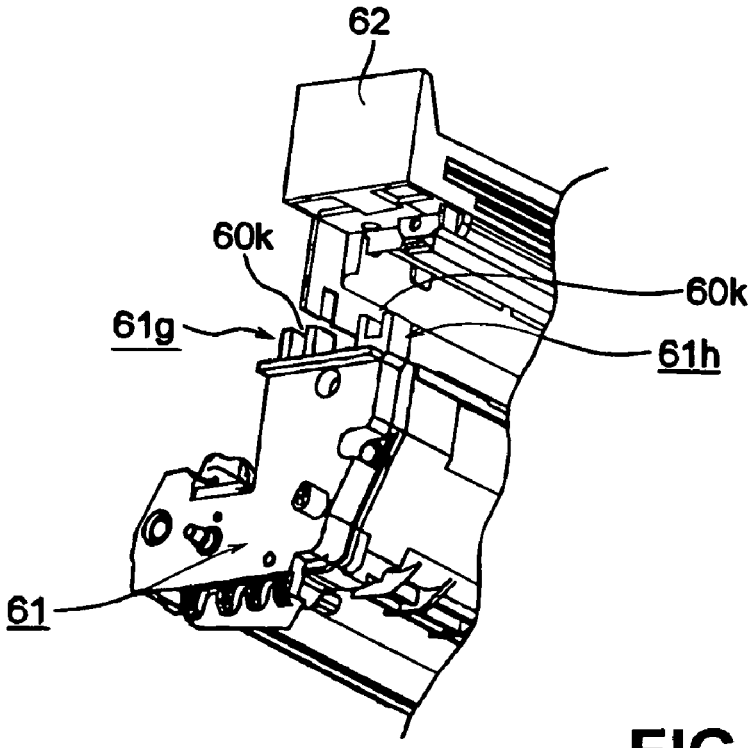
FIG. 40 is an exploded perspective view No. 2 showing the configuration of the regulating groove according to the third embodiment of the present invention.
Figure 41:
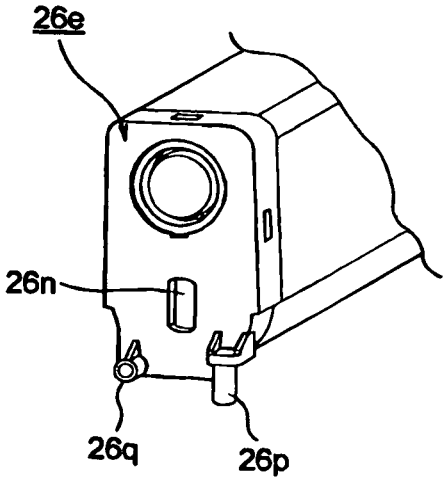
FIG. 41 is a perspective view No. 1 showing a main portion of a toner cartridge according to the third embodiment of the present invention.
Figure 42:
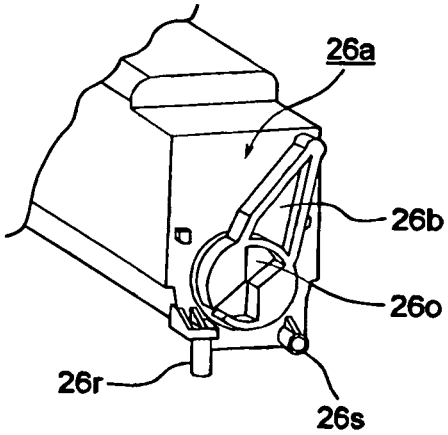
FIG. 42 is a perspective view No. 2 showing the main portion of the toner cartridge according to the third embodiment of the present invention.

FIG. 38 is an exploded perspective view of an image forming unit according to the third embodiment of the present invention. FIG. 39 is an exploded perspective view No. 1 showing a configuration of a regulating groove according to the third embodiment of the present invention. FIG. 40 is an exploded perspective view No. 2 showing the configuration of the regulating groove according to the third embodiment of the present invention. FIG. 41 is a perspective view No. 1 showing a main portion of a toner cartridge according to the third embodiment of the present invention. FIG. 42 is a perspective view No. 2 showing the main portion of the toner cartridge according to the third embodiment of the present invention.

Figure 43:
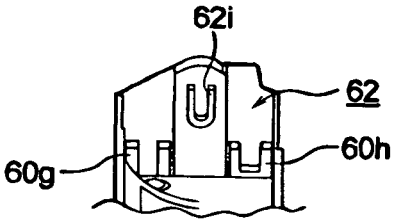
FIG. 43 is a perspective view No. 1 showing a main portion of an image forming unit main body according to the third embodiment of the present invention.
Figure 44:
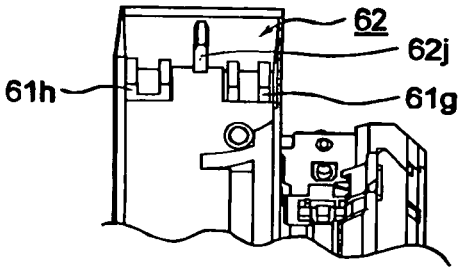
FIG. 44 is a perspective view No. 2 showing the main portion of the image forming unit main body according to the third embodiment of the present invention.

Further, FIG. 43 is a perspective view No. 1 showing a main portion of an image forming unit main body according to the third embodiment of the present invention. FIG. 44 is a perspective view No. 2 showing the main portion of the image forming unit main body according to the third embodiment of the present invention.

In the embodiment, in the storage portion 62*f* of the image forming unit 16Bk, the fixed raised portions 62*i* and 62*j* are provided in a vertical direction inside of the sidewalls of the both end portions of the cover 62 in the same position as in the second embodiment. The fixed raised portions 62*i* and 62*j* are first engagement portions having the same shapes.

As shown in FIGS. 39 and 40, regulating groove members 60*g* and 60*h* and regulating groove members 61*g* and 61*h* are provided integrally with the side housings 60 and 61 near the fixed raised portion 62*i* and 62*j*, respectively. The regulating groove members 60*g*, 60*h*, 61*g*, and 61*h* pierce the cover 62. Further, the regulating groove members 60*g* and 60*h* and the regulating groove members 61*g* and 61*h* are two pairs of first regulating elements arranged in a horizontal direction sandwiching the fixed raised portions 62*i* and 62*j*, respectively.

In the embodiment, when the toner cartridge 26 is attached to the image forming unit main body, the fixed portions 26*n* and 26*o* having recessed shapes are integrally formed with the lever 26*b* and the cap 26*e*, respectively, on the side surfaces of the toner cartridge 26. The fixed portions 26*n* and 26*o* are second engaging portions to fit into the fixed raised portions 62*i* and 62*j*, respectively.

Further, regulating protrusions 26*p* and 26*q* and regulating protrusions 26*r* and 26*s* are integrally formed with the housing 26*a* and the cap 26*e* to protrude from the side surfaces of the toner cartridge 26 near the fixed portions 26*n* and 26*o*. The regulating protrusions 26*p*, 26*q*, 26*r*, and 26*s* having columnar shapes are second regulating elements.

The regulating protrusions 26*p* and 26*r* extend from an end portion of the front side in a bottom edge of the side surface of the toner cartridge 26 downwardly in a vertical direction. Further, when the toner cartridge 26 is attached to the image forming unit main body, outer circumference surfaces of the regulating protrusions 26*p* and 26*r* are fitted into the grooves 60*k* and 61*k* of the regulating groove members 60*g* and 61*g*, respectively.

In the embodiment, the regulating protrusions 26*q* and 26*s* extend from an end portion of rear side in a bottom edge of the side surfaces of the toner cartridge 26 upwardly in a horizontal direction. Further, when the toner cartridge 26 is attached to the image forming unit main body, outer circumference surfaces of the regulating protrusions 26*q* and 26*s* are fitted into the grooves 60*k* and 61*k* of the regulating groove members 60*h* and 61*h*, respectively. Each of the grooves 60*k* and 61*k* is provided with the side surfaces j1 and j2 and the bottom surface j3.

In the embodiment, outer diameters of the regulating protrusions 26*p* and 26*r* are slightly smaller than widths of the grooves 60*k* and 61*k*, respectively. Further, lengths of the regulating protrusions 26*p* and 26*r* in a vertical direction are made smaller enough than the groove depths of the grooves 60*k* and 61*k*, respectively.

Further, outer diameters of the regulating protrusions 26*q* and 26*s* are slightly smaller than widths of the grooves 60*k* and 61*k*, respectively. Lengths of the regulating protrusions 26*q* and 26*s* in a horizontal direction are made long enough to cover the lengths of the grooves 60*k* and 61*k*, respectively.

In the embodiment, fitting portions comprise the regulating groove members 60*g*, 60*h*, 61*g*, and 61*h* and the regulating protrusions 26*p*, 26*q*, 26*r*, and 26*s*, respectively. Further, the regulating protrusions 26*p*, 26*q*, 26*r*, and 26*s* fit into the regulating groove members 60*g*, 60*h*, 61*g*, and 61*h*, respectively. Accordingly, the side surfaces of the regulating protrusions 26*p* and 26*q* and the regulating protrusions 26*r* and 26*s* contact the side surfaces j1 and j2 of the grooves 60*k* and 61*k*, respectively, to regulate.

In the embodiment, dimensions of the outer diameters and the spaces are determined, so that the regulating protrusions 26*p*, 26*q*, 26*r*, and 26*s* can smoothly fit into the regulating groove members 60*g*, 60*h*, 61*g*, and 61*h*, respectively, and the manufacturing cost will not be high.

More specifically, each of the regulating protrusions 26*p*, 26*q*, 26*r*, and 26*s* has an outer diameter equal to or greater than 5.93 mm and equal to or less than 5.98 mm. Further, each of the grooves 60*k* and 61*k* has a width equal to or greater than 6.0 mm and equal to or less than 6.05 mm. Further, a space equal to or greater than 0.02 mm and equal to or less than 0.12 mm is provided.

When the space is less than 0.02 mm, the toner cartridge 26 is difficult to smoothly attach to and detach from the image forming unit main body. More specifically, when toner is adhered to the regulating protrusions 26*p*, 26*q*, 26*r*, and 26*s*, or the regulating groove members 60*g*, 60*h*, 61*g*, and 61*h*, the toner cartridge 26 is difficult to attach to or detach from the image forming unit main body.

On the other hand, when the space is greater than 0.12 mm, the regulating protrusions 26*p*, 26*q*, 26*r*, and 26*s* become loose with respect to the regulating groove members 60*g*, 60*h*, 61*g*, and 61*h*, respectively. Accordingly, it is difficult to prevent the twisting of the image forming unit 16Bk.

Next, an operation of the image forming unit 16Bk of the configuration will be explained.

Figure 45:
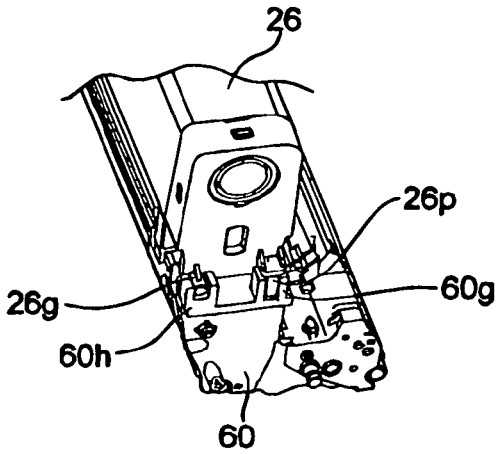
FIG. 45 is a perspective view of the image forming unit according to the third embodiment of the present invention.
Figure 46:
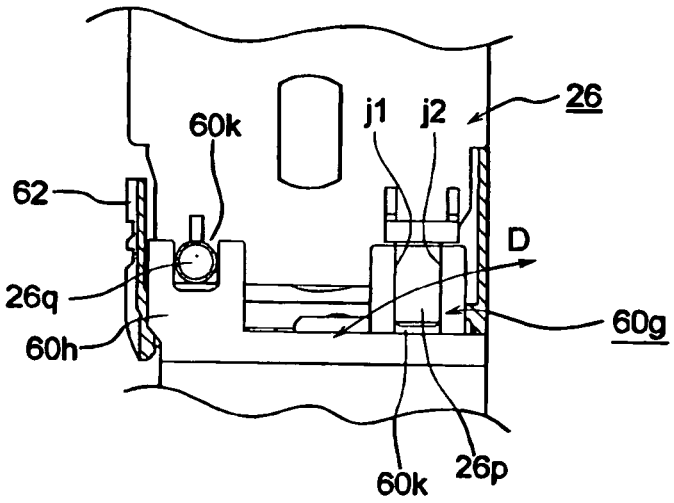
FIG. 46 is a side view of the image forming unit according to the third embodiment of the present invention.
Figure 47:
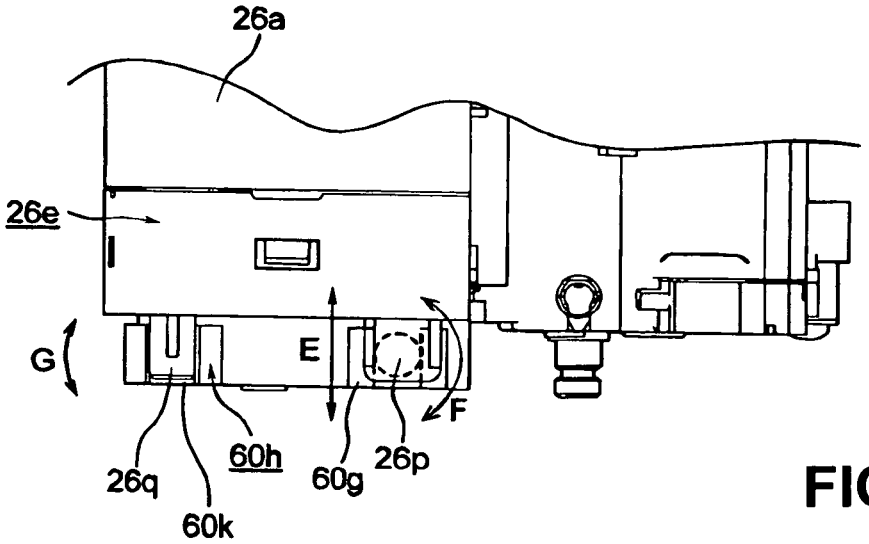
FIG. 47 is a plan view of the image forming unit according to the third embodiment of the present invention.

FIG. 45 is a perspective view of the image forming unit according to the third embodiment of the present invention. FIG. 46 is a side view of the image forming unit according to the third embodiment of the present invention. FIG. 47 is a plan view of the image forming unit according to the third embodiment of the present invention.

When the toner cartridge 26 is attached to the image forming unit main body, as shown in FIG. 45, the toner cartridge 26 is inserted inside of the cover 62. Next, the regulating protrusions 26*p*, 26*q*, 26*r*, and 26*s* of the toner cartridge 26 are fitted into the regulating groove members 60*g*, 60*h*, 61*g*, and 61*h*, respectively, inside of the cover 62. When the lever 26*b* is rotated, the toner cartridge 26 can be fixed to the image forming unit main body.

In the embodiment, in the fitting portions of the regulating protrusions 26*p* and 26*r* and the regulating groove members 60*g* and 61*g*, the side surfaces of the regulating protrusions 26*p* and 26*r* contact the side surfaces j1 and j2 of the grooves 60*k* and 61*k*, respectively. Accordingly, the regulating protrusions 26*p* and 26*r* are regulated not to move in a direction perpendicular to the side the surfaces j1 and j2. Further, rotations of the regulating protrusions 26*p* and 26*r* are regulated.

In the fitting portions of the regulating protrusions 26*p* and 26*r* and the regulating groove members 60*g* and 61*g*, axes of the regulating protrusions 26*p* and 26*r* are regulated not to incline in a direction perpendicular to a rotary shaft of the photosensitive drum 52Bk (direction indicated by an arrow D) or displace. However, the axes of the regulating protrusions 26*p* and 26*r* do not regulate not to incline in a direction parallel to the rotary shaft of the photosensitive drum 52Bk (direction indicated by an arrow E), displace, or rotate around the axes of the regulating protrusions 26*p* and 26*r* (rotate to a direction indicated by an arrow F), respectively. Further, the regulating protrusions 26*p* and 26*r* regulate the side housings 60 and 61 to rotate around the rotary shaft of the photosensitive drum 52Bk, respectively.

On the other hand, in the fitting portions of the regulating protrusions 26*q* and 26*s* and the regulating groove members 60*h* and 61*h*, the axes of the regulating protrusions 26*q* and 26*s* are regulated not to incline or rotate inside of the surface in a horizontal direction parallel to the rotary shaft of the photosensitive drum 52Bk (rotate to a direction indicated by an arrow G).

The regulating protrusions 26*q* and 26*s* regulate a rotation of the side housings 60 and 61 around the rotary shaft of the photosensitive drum 52Bk, respectively. However, angles of the grooves 60*k* and 61*k* with respect to the rotation direction of the photosensitive drum 52Bk are large. Accordingly, the regulating force becomes small.

In the embodiment, the regulating protrusions 26*p* and 26*r* and the grooves 60*k* and 61*k* are provided in a direction in which the toner cartridge 26 is attached to or detached from the image forming unit main body or a vertical direction. Alternatively, the regulating protrusions 26*p* and 26*r* and the grooves 60*k* and 61*k* may be provided to be tilted at a specific angle, as far as the toner cartridge 26 can be smoothly attached to or detached form the image forming unit main body.

As described, in the embodiment, the regulating protrusions 26*p*, 26*q*, 26*r*, and 26*s* are provided to protrude from both side surfaces of the toner cartridge 26. Further, the regulating groove members 60*g* and 61*h* and the regulating groove members 60*g* and 61*h* are provided in the side housings 60 and 61 inside of the image forming unit 16Bk, respectively. Accordingly, twisting of the image forming unit 16Bk can be prevented. Thus, images formed on a left side and a right side become even. Accordingly, an increase of a load torque of the image forming unit 16Bk and changes of the set dimensions of an overlay amount and a space amount are prevented. Accordingly, image quality will be improved.

In the embodiments described above, an example applied to the printer as an image forming apparatus was explained. The present invention can be applied to a copier, a facsimile, MFP, or the likes, in which an image forming unit is attachable to or detachable from an apparatus main body and a toner cartridge is attachable to or detachable from the image forming unit main body.

The present invention is not limited to the embodiments. Variations are possible within a scope of the present invention. The variations are not to be excluded from the present invention.

The disclosure of Japanese Patent Application No. 2007-053125, filed on Mar. 2, 2007 is incorporated in the application by reference.

While the invention has been explained with reference to the specific embodiments of the invention, the explanation is illustrative and the invention is limited only by the appended claims.

What is claimed is:

1. A developer cartridge detachably attached to an image forming unit main body, comprising:

a developer storage portion for retaining developer;

an opening portion formed in the developer storage portion for discharging developer from the storage portion to the image forming unit main body;

a shutter member for opening and closing the opening portion;

a first protrusion portion disposed on at least one of side surfaces of the developer storage portion in a longitudinal direction thereof for engaging a first groove, portion formed in the image forming unit main body, said first protrusion portion extending outwardly in the longitudinal direction; and a second protrusion portion disposed on the at least one of the side surfaces of the developer storage portion for engaging a second groove portion formed in the image forming unit main body, said second protrusion portion extending from a bottom of the developer storage portion in a direction substantially perpendicular to the longitudinal direction, wherein said first protrusion portion and said second protrusion portion are disposed on both of the side surfaces of the developer storage portion.

2. The developer cartridge according to claim 1, wherein said first protrusion portion includes a portion extending in a direction perpendicular to the longitudinal direction.

3. An image forming apparatus, comprising:

a medium storage portion for storing a medium;

a sheet supply mechanism for supplying the medium stored in the medium storage portion;

an image forming unit for forming a developer image, said image forming unit including an image forming unit main body and a developer cartridge detachably attached to the image forming unit main body, said image forming unit main body including a storage portion for retaining the developer cartridge, a first groove portion, and a second groove portion, said developer cartridge including a developer storage portion with an opening portion for retaining developer, a shutter member for opening and closing the opening portion, a first protrusion portion disposed on at least one of side surfaces of the developer storage portion in a longitudinal direction thereof for engaging the first groove portion, and a second protrusion portion disposed on the at least one of the side surfaces of the developer storage portion for engaging the second groove portion, said first protrusion portion extending outwardly in the longitudinal direction, said second protrusion portion extending from a bottom of the developer storage portion in a direction substantially perpendicular to the longitudinal direction;

a transfer unit for transferring a developer image to the medium; and a fixing unit for fixing the developer image to the medium, wherein said first protrusion portion and said second protrusion portion are disposed on both of the side surfaces of the developer storage portion.

4. The image forming apparatus according to claim 3, wherein said image forming unit further includes an image supporting member for supporting a latent image, a developer supporting member for developing the latent image, and a support portion for supporting the image supporting member and the developer supporting member to be rotatable, said groove portion being disposed in the support portion.

5. The image forming apparatus according to claim 4, wherein said support portion includes a side housing.

6. An image forming apparatus, comprising:

a medium storage portion for storing a medium;

a sheet supply mechanism for supplying the medium stored in the medium storage portion;

an image forming unit for forming a developer image, said image forming unit including an image forming unit main body aid a developer cartridge detachably attached to the image forming unit main body, said image forming unit main body including a storage portion for retaining the developer cartridge a first groove portion, and a second groove portion, said developer cartridge including a developer storage portion with an opening portion for retaining developer, a shutter member for opening and closing the opening portion, a first protrusion portion disposed on at least one of side surfaces of the developer storage portion in a longitudinal direction thereof for engaging the first groove portion, and a second protrusion portion disposed on the at least one of the side surfaces of the developer storage portion for engaging the second groove portion, said first protrusion portion extending outwardly in the longitudinal direction, said second protrusion portion extending from a bottom of the developer storage portion in a direction substantially perpendicular to the longitudinal direction;

a transfer unit for transferring a developer image to the medium; and a fixing unit for fixing the developer image to the medium, wherein said image forming unit further includes an image supporting member for supporting a latent image, and a supporting shaft for supporting the image supporting member to be rotatable, said supporting shaft being arranged so that a line connecting between the supporting shaft and the first protrusion portion is aligned with a direction that the groove portion extends.

7. The image forming apparatus according to claim 3, wherein said image forming unit further includes an image supporting member for supporting a latent image, and a supporting shaft for supporting the image supporting member to be rotatable, said supporting shaft being arranged so that a line connecting between the supporting shaft and the first protrusion portion is aligned with a direction that the groove portion extends by an angle less than 90 degrees.

8. The image forming apparatus according to claim 3, wherein said image forming unit further includes a first engagement portion, said developer cartridge further including a second engagement portion for engaging the first engagement portion.

9. The image forming apparatus according to claim 3, wherein said first protrusion portion includes a portion extending in a direction perpendicular to the longitudinal direction.

10. The image forming apparatus according to claim 3, wherein each of said first groove portion and said second groove portion includes a first wall portion and a second wall portion both extending in a direction that the developer cartridge is inserted into the image forming unit main body.

11. The image forming apparatus according to claim 10, further comprising a rotational member attached to the image forming unit main body, said first wall portion and said second wall portion being arranged to prevent the image forming unit main body from excessively twisting when the rotational member rotates.

12. The developer cartridge according to claim 1, wherein at least one of said first protrusion portion and said second protrusion portion includes a circular cylindrical portion.

13. The image forming apparatus according to claim 3, wherein at least one of said first protrusion portion and said second protrusion portion includes a circular cylindrical portion.

14. The image forming apparatus according to claim 6, wherein said image forming unit further includes an image supporting member for supporting a latent image, a developer supporting member for developing the latent image, and a support portion for supporting the image supporting member and the developer supporting member to be rotatable, said groove portion being disposed in the support portion.

15. The image forming apparatus according to claim 14, wherein said support portion includes a side housing.

16. The image forming apparatus according to claim 6, wherein said image forming unit further includes an image supporting member for supporting a latent image, and a supporting shaft for supporting the image supporting member to be rotatable, said supporting shaft being arranged so that a line connecting between the supporting shaft and the first protrusion portion is aligned with a direction that the groove portion extends by an angle less than 90 degrees.

17. The image forming apparatus according to claim 6, wherein said image forming unit further includes a first engagement portion, said developer cartridge further including a second engagement portion for engaging the first engagement portion.

18. The image forming apparatus according to claim 6, wherein said first protrusion portion includes a portion extending in a direction perpendicular to the longitudinal direction.

19. The image forming apparatus according to claim 6, wherein each of said first groove portion and, said second groove portion includes a first wall portion and a second wall portion both extending in a direction that the developer cartridge is inserted into the image forming unit main body.

20. The image forming apparatus according to claim 19, further comprising a rotational member attached to the image forming unit main body, said first wall portion and said second wall portion being arranged to prevent the image forming unit main body from excessively twisting when the rotational member rotates.

21. The image forming apparatus according to claim 6, wherein at least one of said first protrusion portion and said second protrusion portion includes a circular cylindrical portion.

* * * * *